US006925279B2

(12) United States Patent
Kamoshita et al.

(10) Patent No.: US 6,925,279 B2
(45) Date of Patent: Aug. 2, 2005

(54) BELT MOVING DEVICE AND IMAGE FORMING APPARATUS INCLUDING THE SAME

(75) Inventors: Mikio Kamoshita, Koganei (JP); Koichi Kudo, Yokohama (JP)

(73) Assignee: Ricoh Company, Ltd., Tokyo (JP)

( * ) Notice: Subject to any disclaimer, the term of this patent is extended or adjusted under 35 U.S.C. 154(b) by 180 days.

(21) Appl. No.: 10/368,574

(22) Filed: Feb. 20, 2003

(65) Prior Publication Data

US 2003/0223786 A1 Dec. 4, 2003

(30) Foreign Application Priority Data

Feb. 20, 2002 (JP) ..... 2002-043384

(51) Int. Cl.[7] ..... G03G 15/01
(52) U.S. Cl. ..... 399/303; 399/162; 399/167
(58) Field of Search ..... 399/162, 163, 399/167, 297, 298, 301, 302, 303, 308

(56) References Cited

U.S. PATENT DOCUMENTS 5,574,558 A 11/1996 Kudo et al.
5,729,024 A 3/1998 Baba et al.
5,818,062 A 10/1998 Baba et al.
5,929,436 A 7/1999 Baba et al.
6,031,633 A 2/2000 Andoh et al.
6,252,682 B1 6/2001 Baba et al.

FOREIGN PATENT DOCUMENTS

JP 10-232566 9/1998
JP 2001-5363 1/2001
JP 2002-258574 9/2002

*Primary Examiner*—Hoang Ngo
(74) *Attorney, Agent, or Firm*—Oblon, Spivak, McClelland, Maier & Neustadt, P.C.

(57) ABSTRACT

A belt moving device of the present invention includes a drive shaft for moving the belt and a drive transfer line for transferring the output torque of a motor to the drive shaft. A marker sensor senses a marker positioned on the belt to thereby determine the position of the belt in the direction of movement. A rotation condition sensor senses the rotation condition of the drive shaft. A first correction information generating circuit generates, based on the output of the marker sensor, correction information for correcting the position of the belt. A second correction information generating circuit generates, based on the output of the rotation condition sensor, correction information for correcting the rotation condition of the drive shaft. A controller controls the movement of the motor in accordance with the correction information output from the first and second correction information generating circuits.

52 Claims, 18 Drawing Sheets

BELT MOVING DEVICE AND IMAGE FORMING APPARATUS INCLUDING THE SAME

BACKGROUND OF THE INVENTION

1. Field of the Invention

The present invention relates to a belt moving device for controllably moving a belt and more particularly to a belt moving device capable of accurately controlling the position of an intermediate image transfer belt included in a color image forming apparatus, and an image forming apparatus including the same.

2. Description of the Background Art

An intermediate image transfer belt included in a color printer or similar color image forming apparatus has its position controlled by a belt moving device. The problem with a conventional belt moving device is that because it controls the position of the belt on a speed basis, positional deviation increases with the elapse of time. Particularly, in a color copier configured to sequentially transfer a black, a yellow, a magenta and a cyan toner image to the belt one above the other, the above positional deviation results in color misregister. The color misregister cannot be canceled when the positional deviation is derived from, e.g., disturbance. More specifically, while position control allows, even when misregister occurs, the belt to follow a target position later, speed control cannot do so. This will be described more specifically later with reference to the accompanying drawings.

Further, as for a drive roller for driving the belt, speed control is effective for a frequency as low as the rotation period of the roller, but cannot cope with banding or similar speed variation whose frequency is high.

Technologies relating to the present invention are disclosed in, e.g., Japanese Patent Laid-Open Publication Nos. 6-263281, 10-232566, 2001-5363 and 2002-258574.

SUMMARY OF THE INVENTION

It is an object of the present invention to provide a belt moving device capable of performing highly accurate position control by reducing banding or similar speed variation of a belt and positional deviation from a target belt position, and an image forming apparatus including the same and capable of forming high-quality images by obviating color misregister.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

Figure 1:
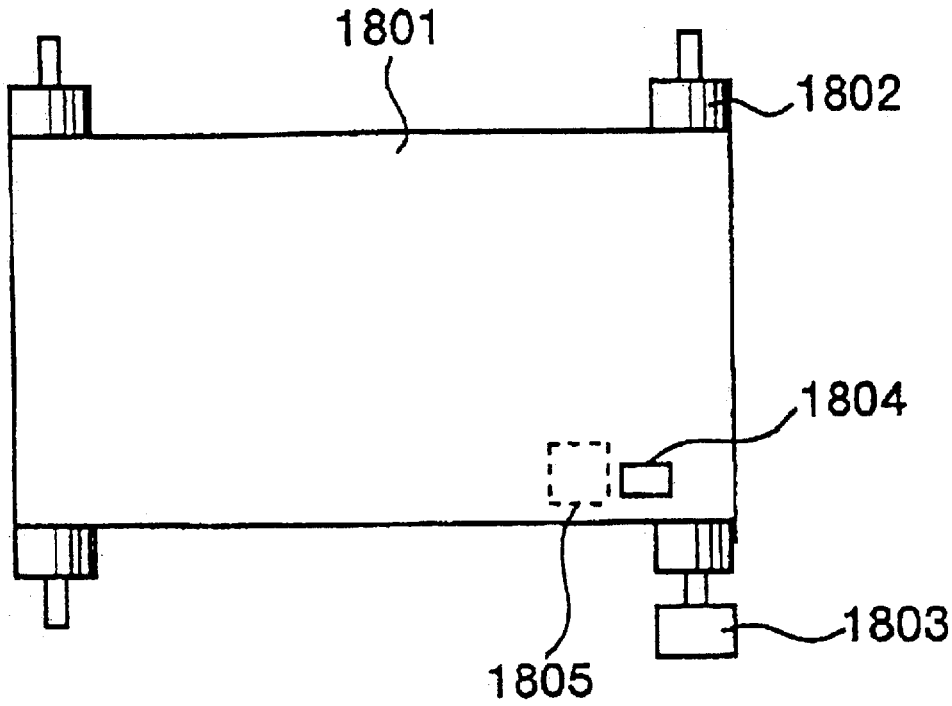
FIG. 1 PRIOR ART
FIG. 1 is a plan view showing a conventional belt moving device.

To better understand the present invention, brief reference will be made to the prior art belt moving device taught in Japanese Patent Laid-Open Publication No. 6-263281 mentioned earlier. As shown in FIG. 1, the prior art belt moving device includes a drive roller 1802 over which an endless belt 1801 is passed. An encoder 1803 is mounted on the drive roller 1802 and generates an index signal every time the drive roller 1802 completes one rotation. A sensor 1805 senses a single mark 1804 provided on the belt 1801.

Control means, not shown, determines the variation of the moving speed of the belt 1801, i.e., the eccentricity of the drive roller 1802 on the basis of a relation between the index signal and the output of the sensor 1805. The control means then executes speed control in such a manner as to compensate for the eccentricity. The belt 1801 is used as an intermediate image transfer belt included in an image forming apparatus and turns a number of times corresponding to the number of colors for forming an image. The control means reads a speed pattern during drive for the first color and uses it as a speed pattern for second and successive colors.

Further, to obviate the speed variation of the belt 1801 ascribable to the eccentricity of the drive roller 1802, the control means controls the speed of the drive roller 1802 in such a manner as to cancel the speed variation of the belt 1801. More specifically, by using the deviation of the circumferential length of the belt 1801, the control means determines correspondence between the rotation angle of the drive roller 1802 and the speed variation of the belt 1801 by Fourier transform. The control means then adds a phase and an amplitude to the target speed of the drive roller 1802 for thereby maintaining the speed of the belt 1801 constant.

However, a problem with the belt moving device described above is that because the position of the belt 1801 is controlled by speed control, the positional deviation increases with the elapse of time. As a result, after a positional error has occurred, the deviated condition cannot be corrected. Further, as for the drive roller 1802, the speed control cannot cope with high-frequency sped variation.

Figure 2:
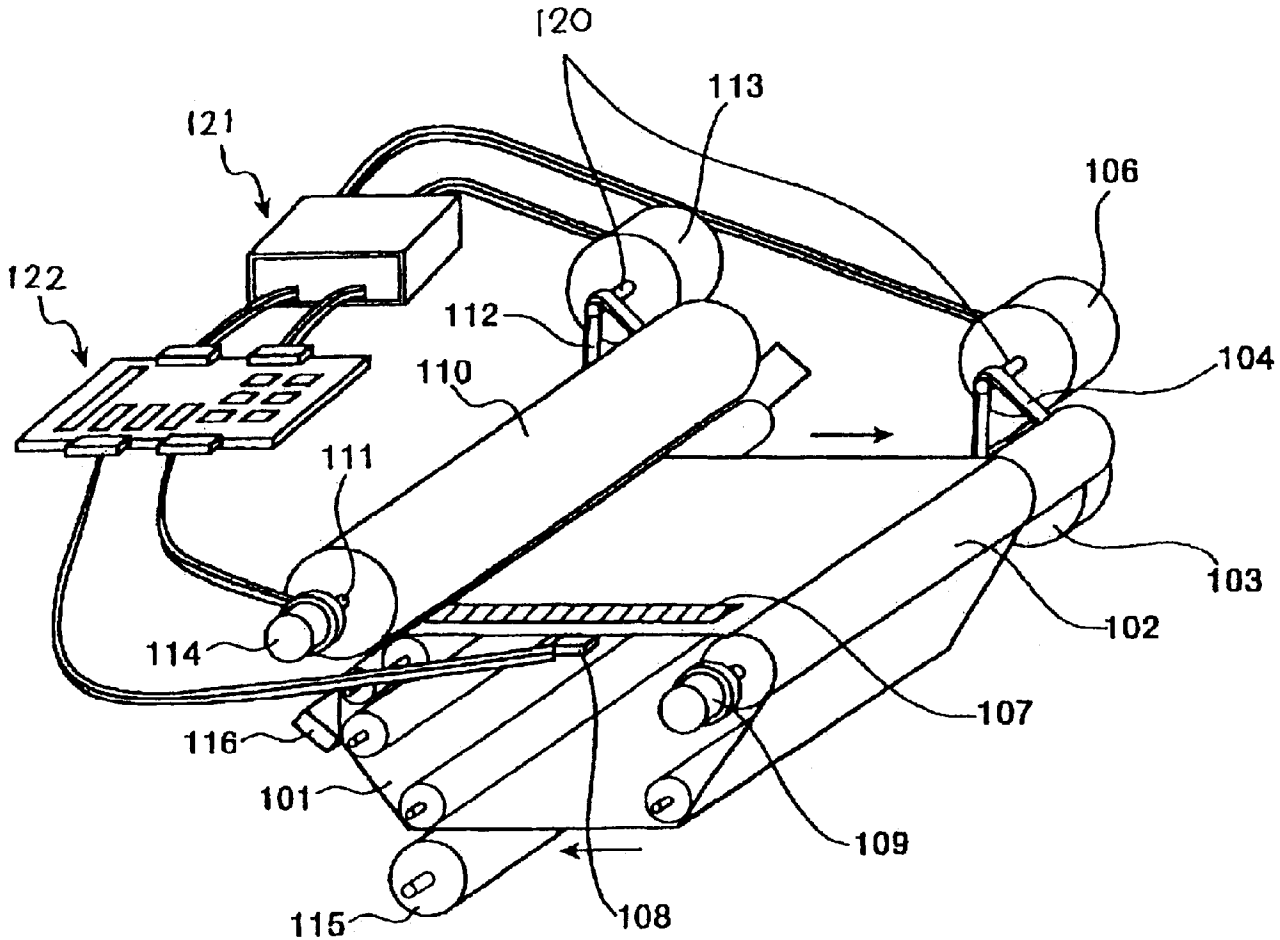
FIG. 2 is an isometric view showing the general construction of a belt moving device in accordance with the present invention.

Referring to FIG. 2, a belt moving device in accordance with the present invention is shown and applied to an intermediate image transfer belt included in an image forming apparatus by way of example. As shown, the belt moving device includes a drive shaft 102 over which an intermediate image transfer belt (simply belt hereinafter) 101 is passed. A belt motor or drive source 106 is drivably connected to the drive shaft 102 via a timing belt 104 and a timing pulley 103. An encoder scale 107 is formed on the surface of the belt 101 and extends over a preselected length in the direction of conveyance outside of an image forming range. The encoder scale 107 is implemented as a series of slits. An optical head or sensor 108 is positioned to face the encoder scale 107 for thereby sensing the movement of the encoder scale 107. An encoder 109 is mounted on the drive shaft 102 in order to sense the rotation of the drive shaft 102.

A drum motor 113 is drivably connected to a photoconductive drum 110, which is a specific form of an image carrier, via a timing pulley 120, a timing belt 112, and a drive shaft 111 on which the drum 110 is mounted. A rotary encoder 114 is mounted on the drive shaft 111 for sensing the rotation of the drive shaft 111. The reference numeral 115 designates a secondary image transfer roller used to transfer a toner image from the belt 101 to a sheet or recording medium, as will be described more specifically later. The secondary image transfer roller 115 is connected to a motor, not shown, via a driveline including a timing pulley and timing belt.

The drum 110 and secondary image transfer roller 115 are positioned at opposite sides of a laser head 116; the former and the latter are respectively positioned at the upstream side and the downstream side in a direction in which the belt 101 moves, indicated by an arrow in FIG. 2. The drum 110 is rotatable in contact with the belt 101 while the belt 101 and secondary image transfer roller 115 are rotatable in contact with each other via a sheet. A charge roller, a cleaning blade and so forth are arranged around the drum 110, although not shown specifically. There are also shown in FIG. 2 a motor driver 121 and a DPS motor controller 122.

While the belt moving device of the present invention is configured to drive the intermediate image transfer belt 101, the driveline shown in FIG. 2 is also used when the illustrative embodiment drives a simple sheet conveying belt. The driveline using the timing belt may be replaced with a driveline using a gear train or a direct mechanism in which a motor is directly connected to a member to be driven. The belt motor 106 and drive shaft 102 may be connected via a coupling, if desired. Further, the encoder mounted on the drive shaft may alternatively be mounted on the output shaft of the motor.

The encoder 109 mounted on the drive shaft 102 or the rotary encoder mounted on the drive shaft 111 may be implemented as an eccentricity correction encoder. In this case, the eccentricity of the encoder, if any, can be corrected, so that motor position control is free from eccentricity position errors.

Figure 3:
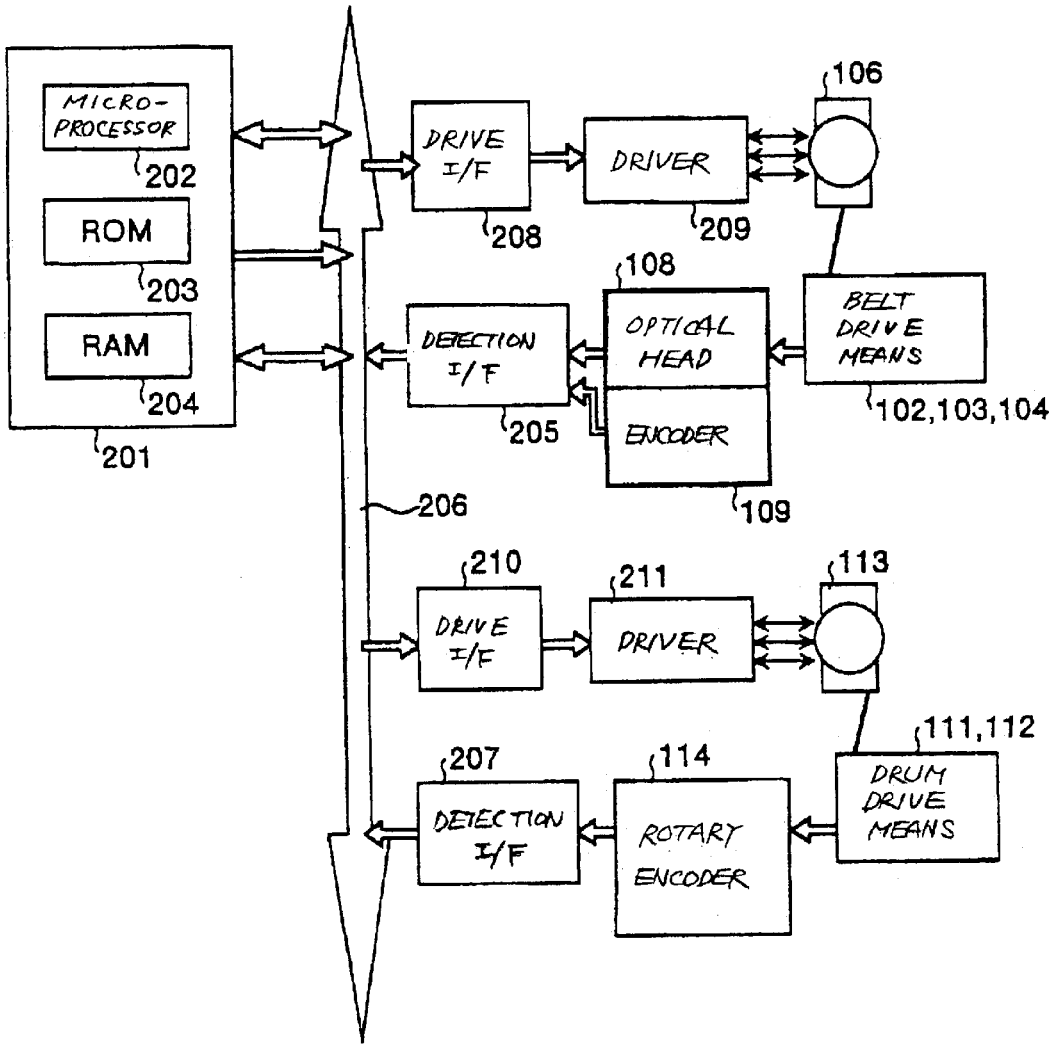
FIG. 3 is a schematic block diagram showing a control system unique to the present invention.

FIG. 3 shows a control system included in the present invention. As shown, the control system includes a microcomputer 201 for controlling the operation of the entire belt moving mechanism. The microcomputer 201 includes a microprocessor or CPU (Central Processing Unit) 202, a ROM (Read Only Memory) 203 and a RAM (Random Access Memory) 204 interconnected by a bus not shown. The outputs of the optical head 108 and encoder 109 are input to the microcomputer 201 via a detection interface (I/F) and a bus 206. Likewise, the output of the rotary encoder 114 is input to the microcomputer 201 via a detection I/F 207 and the bus 206.

The detection I/Fs 205 and 207 each convert the associated encoder output to a digital numerical value and include a counter for counting encoder pulses. Further, by using the origin information of the encoders, the detection I/Fs 205 and 207 establish correspondence, or correlation, between the position of the belt 101 and that of the drum 110 on the basis of the counts.

The belt motor 106 is connected to the microcomputer 201 via a driver 209, a drive I/F 208, and the bus 206. Likewise, the drum motor 113 is connected to the microcomputer 201 via a driver 211, a drive I/F 210, and the bus 206. The drive I/Fs 208 and 210 each convert a digital signal representative of a particular result of calculation output from the microcomputer 201 to an analog signal and delivers the analog signal to the driver 209 or 211 associated therewith. Consequently, currents and voltages to be applied to the belt motor 106 and drum motor 113 are controlled.

With the above configuration, the microcomputer 201 causes each of the belt 101 and drum 110 to be driven in such a manner as to follow a preselected target position. The positions of the belt 101 and drum 110 being so controlled are sent to the microcomputer 201 via the detection I/Fs 205 and 207, respectively.

The position control of the belt moving device is implemented by the calculating function of the microcomputer 201. The microcomputer 201 may be replaced with a DSP (Digital Signal Processor) having high calculation performance, if desired. By processing software servo with a single DSP or a single microcomputer, it is possible to effect the calculation of a controller and an observer and the calculation of a target value locus and feed-forward value with software. This obviates the need for sophisticated circuitry for thereby realizing low cost, highly accurate positioning control.

Figure 4:
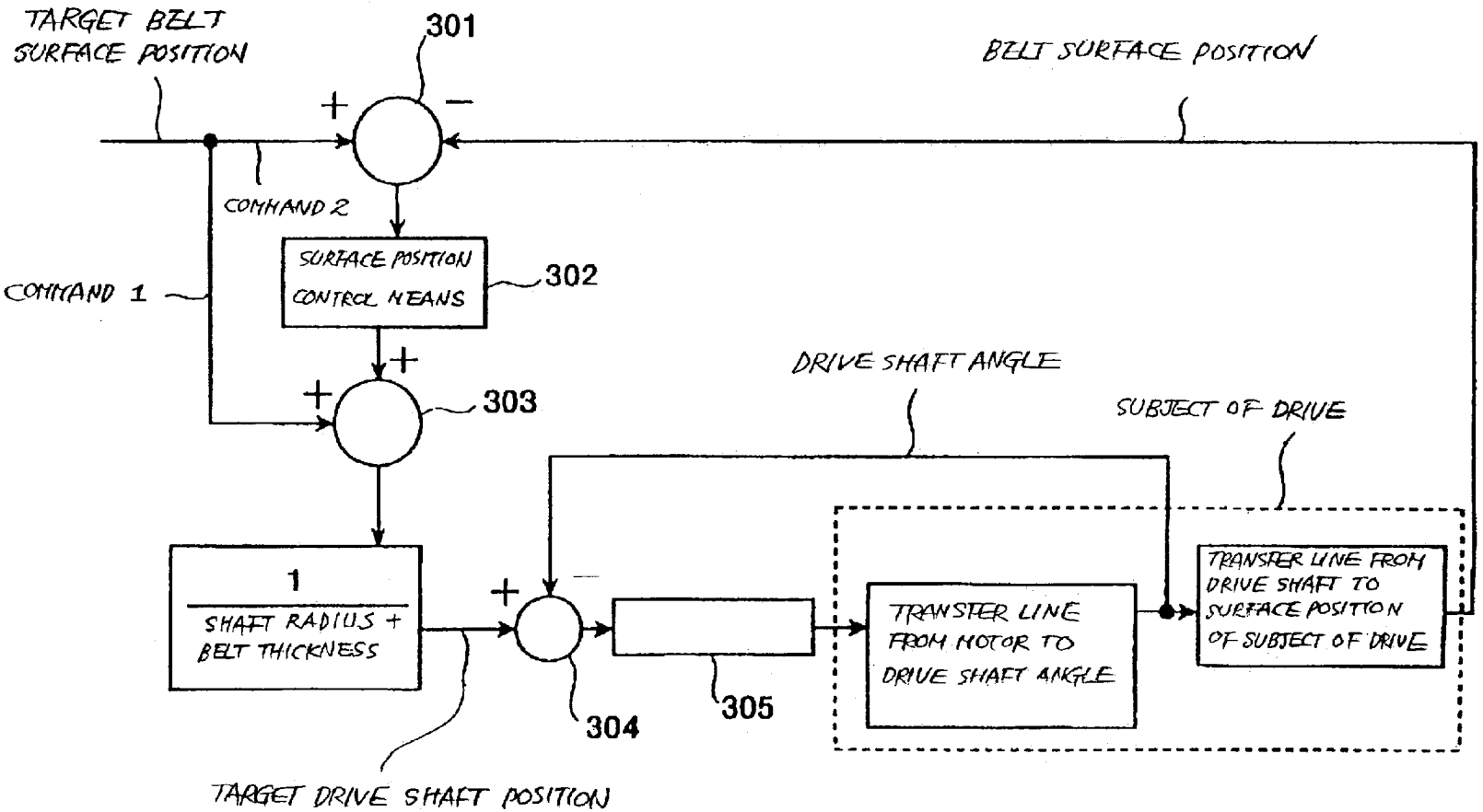
FIG. 4 is a schematic block diagram demonstrating position control representative of a first embodiment of the present invention.

FIG. 4 demonstrates position control representative of a first embodiment of the present invention and executed by the microcomputer 201, FIG. 3. The position control executes correction by using the angle of the drive shaft 102 as a reference. As shown, a command 1 representative of the target surface position of the belt 101 is directly converted to the target position or angle of the drive shaft 102. Comparing means 301 compares a command 2 also representative of the same target position and a surface position of the belt 101. Subsequently, surface position control means 302 produces a difference between the target surface position and the surface position and converts the difference to a target drive shaft position or angle. Adding means 303 adds the target drive shaft position to the command 1, e.g., produces a sum (1/(shaft radius+belt thickness)).

Subsequently, another comparing means 304 compares the target drive shaft position or angle and a drive shaft angle. Position control means 305 produces a difference between the target drive shaft position and the drive shaft position and then feeds the difference to the motor 106 to be driven in the form of a current. As a result, the motor 106, i.e., the subject of drive is driven while following the target position.

So long as the belt surface position is coincident with the target belt surface position, the command 1 is directly used to control the position of the drive shaft 102. However, if the two positions are different from each other due to, e.g., the slip of the belt 101 or eccentricity produced in the drive shaft 102, then the target angle of the drive shaft 102 is so corrected as to cancel the difference, as stated above. As shown in FIG. 4, the drive transfer line assigned to the subject of drive is made up of a transfer line extending from the belt motor 106, which outputs the drive shaft angle, to the angle of the drive shaft 102 and a transfer line extending from the drive shaft 102, which outputs the surface position of the belt 101, to the surface position of the belt 101.

Figure 5:
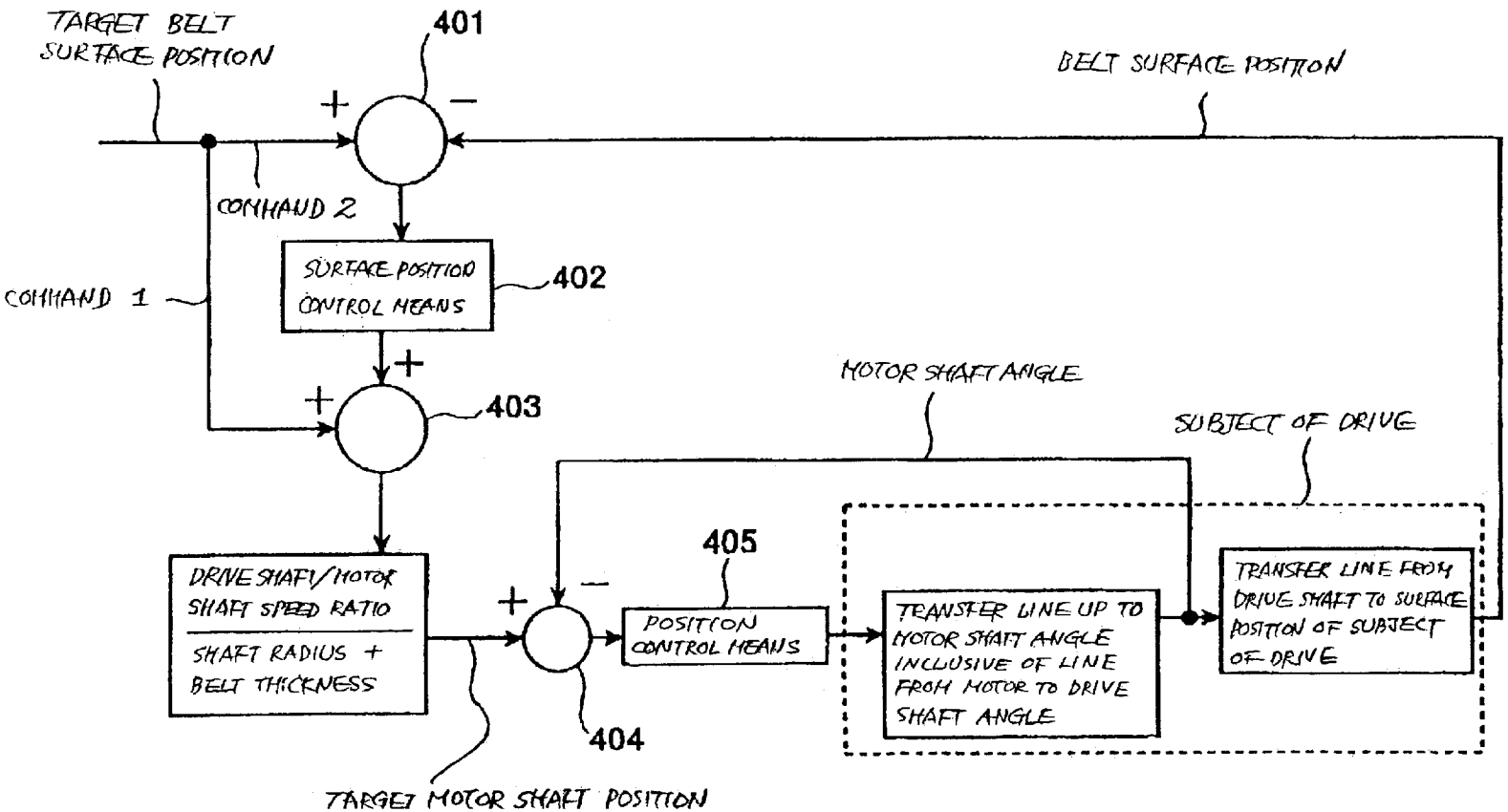
FIG. 5 is a schematic block diagram demonstrating position control representative of a second embodiment of the present invention.

FIG. 5 shows position control representative of a second embodiment of the present invention. The position control executes correction, including the correction of the drive shaft 102, by using the angle of the output shaft of the belt motor 106 as a reference. As shown, a command 1 representative of the target surface position of the belt 101 is directly converted to a target motor output shaft position or angle. Comparing means 401 compares a command 2 also representative of the target surface position and a surface position of the belt 101. Subsequently, surface position control means 402 produces a difference between the target surface position and the surface position and converts the difference to a target motor output shaft position or angle. Adding means 403 adds the target motor output shaft position to the command 1, e.g., produces a sum (speed ratio between drive shaft and motor output shaft/(shaft radius+ belt thickness)).

Subsequently, another comparing means 404 compares the target motor output shaft position or angle and a motor output shaft position or angle. Position control means 405 produces a difference between the target motor output shaft position and the motor output shaft position and then feeds the difference to the subject of drive, i.e., motor 106 in the form of a current. As a result, the motor 106 is driven to follow the target position.

So long as the surface position of the belt 101 is coincident with the target surface position, the command 1 is directly used to control the position of the belt motor 106. However, when the two positions are different from each other due to, e.g., the slip of the belt 101, the eccentricity of the drive shaft 102, the eccentricity of the timing pulley 103 or the shift of the core of the timing belt 104, the target output shaft angle of the belt motor 106 is corrected to cancel the difference, as stated above. As shown in FIG. 5, the drive transfer line assigned to the subject of drive is made up of a transfer line up to output shaft angle of the belt motor 106 inclusive of a transfer line from the belt motor 106, which outputs the output shaft angle, to the drive shaft 102 and a transfer line extending from the drive shaft 102, which outputs the surface position of the belt 101, to the surface position of the belt 101.

Figure 6:
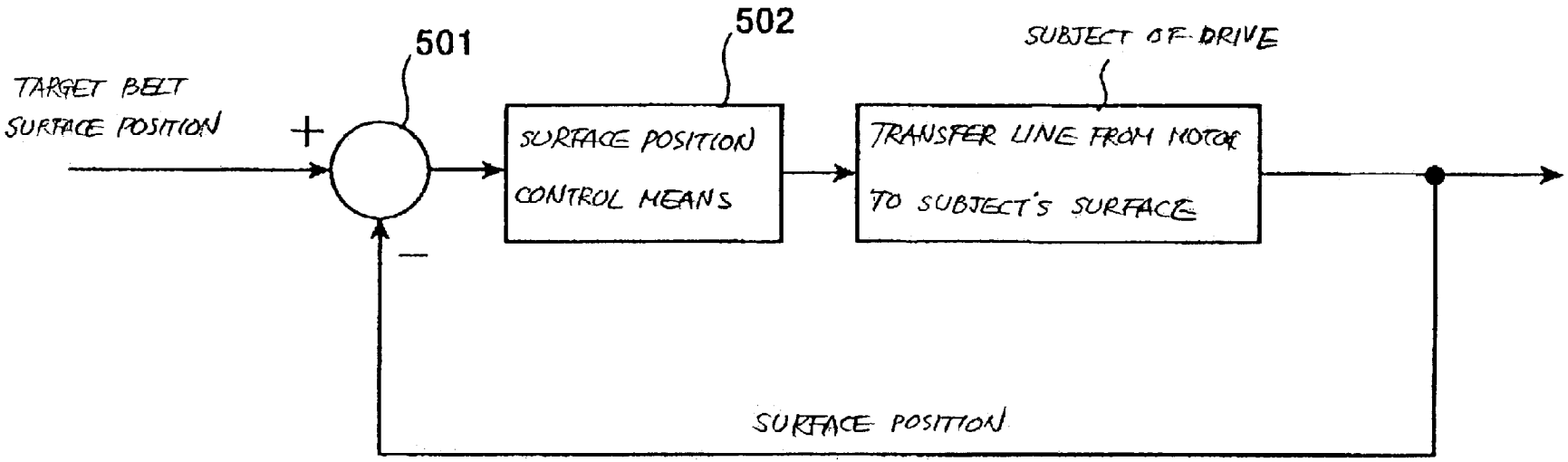
FIG. 6 is a schematic block diagram demonstrating position control representative of a third embodiment of the present invention.

FIG. 6 demonstrates position control representative of a third embodiment of the present invention. As shown, comparing means 501 compares a target belt surface position and a belt surface position while surface position control means 502 produces a difference between the two positions. The control means 502 then feeds a current to the belt motor 106 in accordance with the above result, causing the subject of drive to move while following the target position.

In the illustrative embodiment, the subject of drive is the drive transfer line extending from the belt motor 106 to the surface position of the belt 101, which is the subject of drive. With this configuration, it is possible to control the position of the belt 101 only on the basis of the output of the optical head or sensor 108, i.e., without using the output of the encoder 109.

Figure 7A:
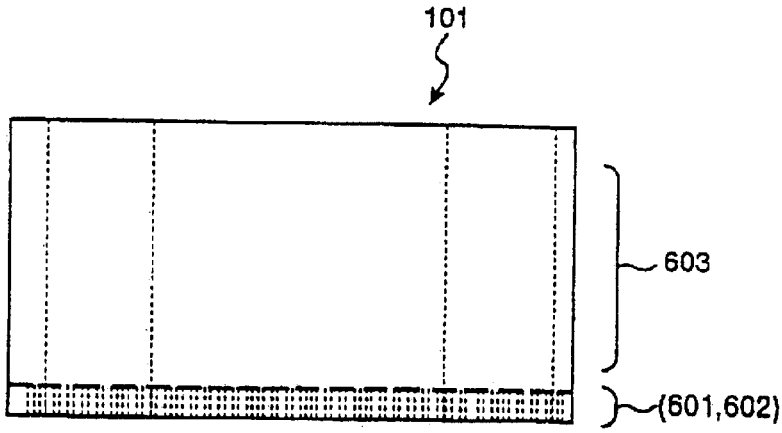
FIG. 7A is a plan view showing a specific configuration of an intermediate image transfer belt which is a subject of drive.
Figure 7B:
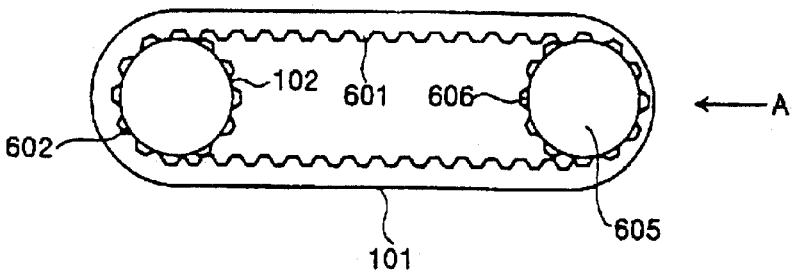
FIG. 7B is a section showing the belt of FIG. 7A.
Figure 7C:
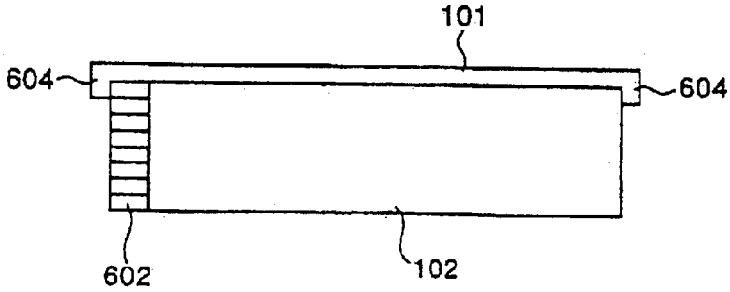
FIG. 7C is a view as seen in a direction indicated by an arrow A in FIG. 7B.

FIGS. 7A through 7C show a specific configuration of the belt 101. As shown, the belt 101 is so configured as not to slip on the drive shaft 102. More specifically, the belt 101 and drive shaft 102 are respectively formed with teeth 601 and 602 meshing with each other. The teeth 601 and 602 are positioned at one widthwise edge portion of the belt 101 and drive shaft 102, respectively, outside of an image forming range 603, which is the center portion of the belt 101. This prevents vibration ascribable to the intermeshing teeth 601 and 602 from being transferred to the image forming range 603. Anti-offset portions 604 extend out from opposite edges of the belt 101, so that the belt 101 does not move in the axial direction of the drive shaft 102.

A driven roller 605 may also be formed with teeth 606 meshing with the teeth 601 of the belt 101. When the driven roller 605 is not formed with the teeth 606, the length of the driven roller 605 will be reduced in the axial direction. While the belt 101 is shown as being passed over the drive roller 102 and driven roller 605, it is, in practice, passed over three or more rollers, as shown in FIG. 1. The rollers other than the rollers 102 and 605 each may also be formed with teeth or reduced in length in the axial direction, as desired.

The rollers on the driven shafts other than the drive shaft 102 each may be provided with a large coefficient of friction by being formed of, e.g., stainless steel and subject to dip coating. This successfully frees the rollers on the shafts other than the drive shaft 102 and not formed with the teeth 602 from slip.

Figure 8:
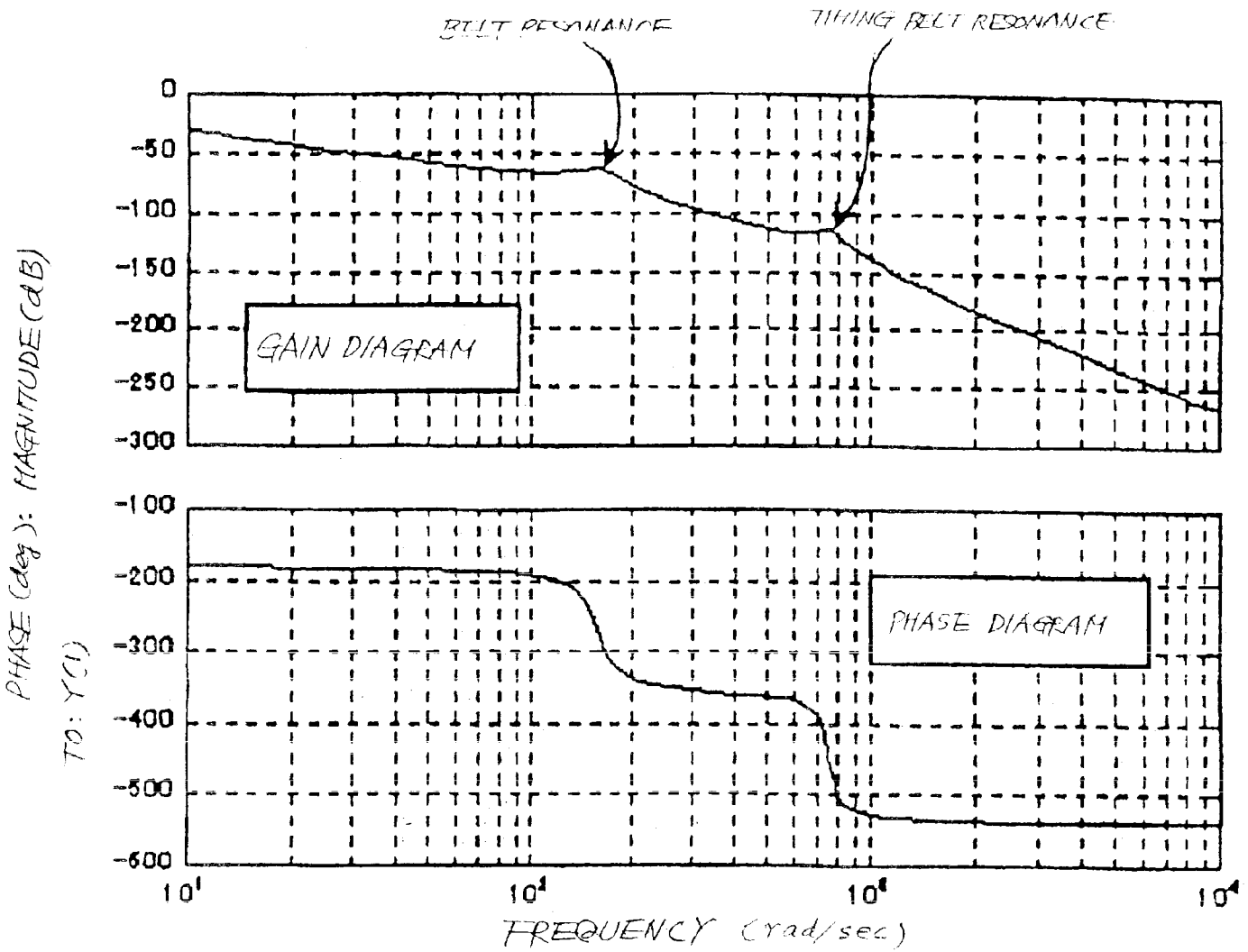
FIG. 8 shows Bode diagrams from a motor torque, which is the subject of drive, to the surface position of the belt.

FIG. 8 shows Bode diagrams extending from motor output torque, which is the subject of drive, to the belt surface position. As shown, the a natural oscillation frequency (resonance frequency) Wpd from the torque of the drive shaft 102 to the surface position of the belt 101 is 25 hz (157 rad/sec). Also, a natural oscillation frequency (resonance frequency) particular to a transfer line from the output of the belt motor 106 to the drive shaft 102 is 120 Hz (754 rad/sec)

Figure 9:
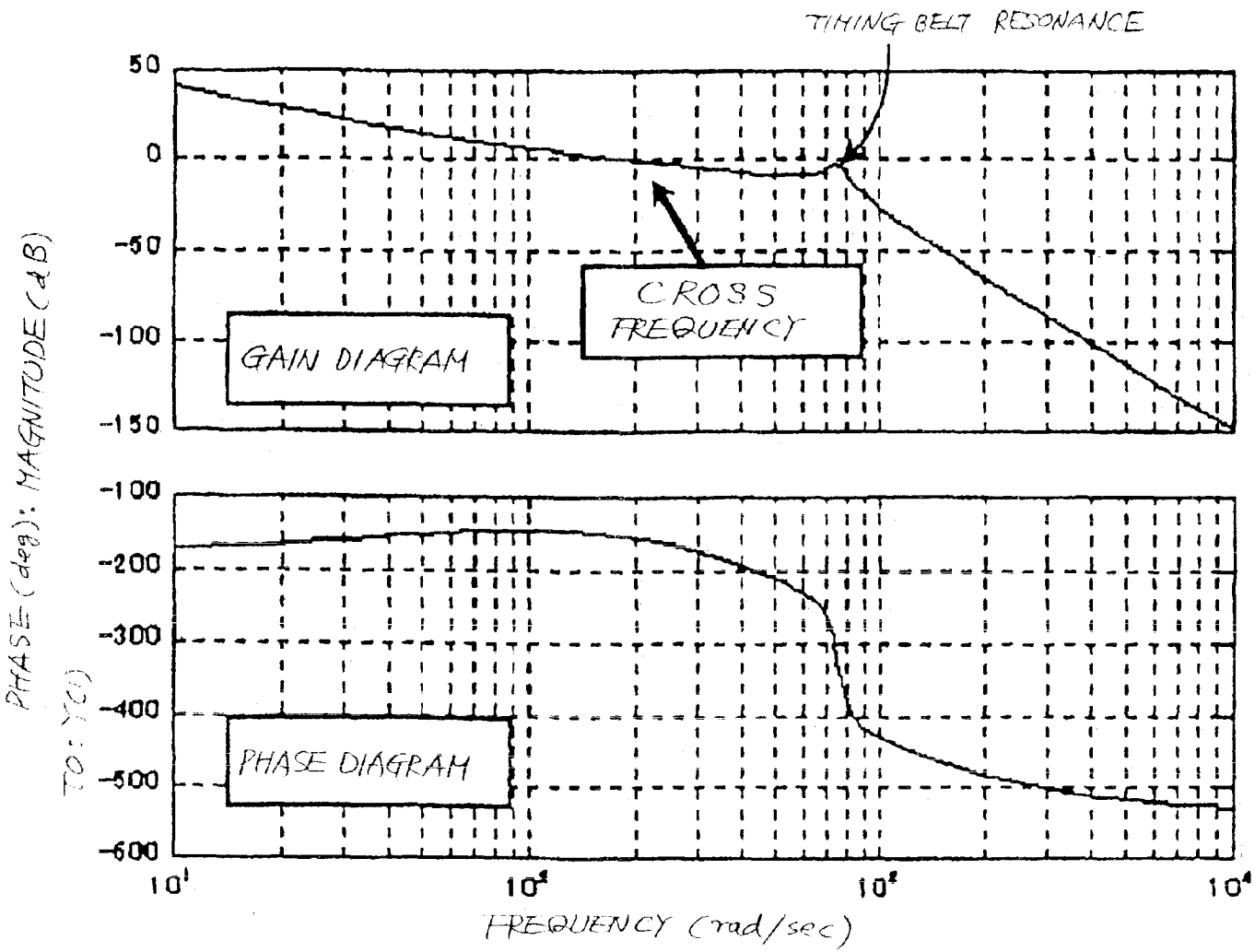
FIG. 9 shows Bode diagrams representative of open-loop transfer characteristics from a target drive shaft angle to a drive shaft angle inclusive of a controller.

FIG. 9 shows Bode Diagrams representative of open-loop transfer characteristics from the target drive shaft angle to the drive shaft angle inclusive of a controller. As shown, a cross frequency Wcd is 30 Hz (188 rad/sec). In this condition and if the resonance frequency Wpd is 25 Hz (157 rad/sec), then the surface position control described in relation to the first embodiment (FIG. 4) is also executed in order to obviate the deviation of the target drive shaft angle from the target surface position of the subject of drive.

Figure 10:
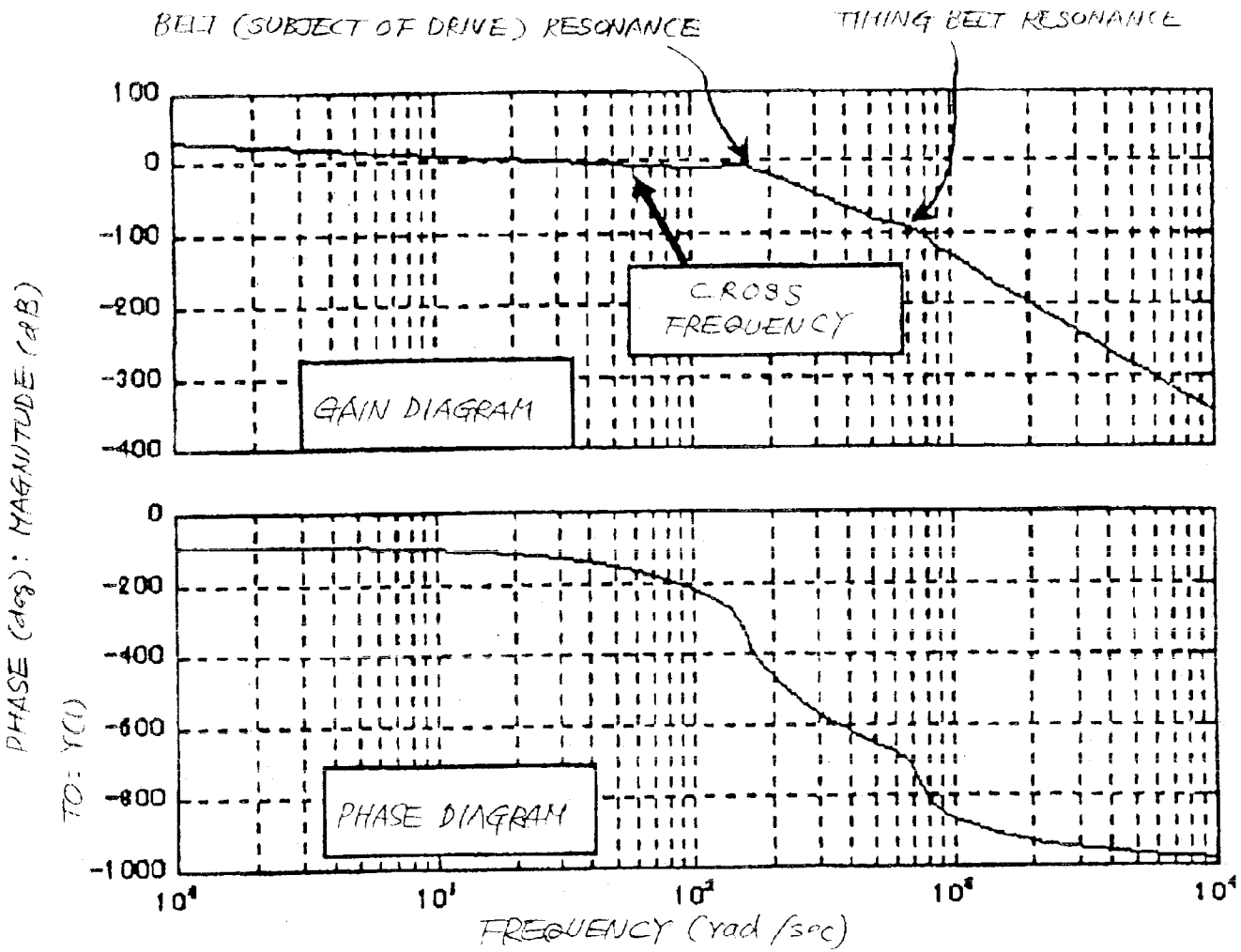
FIG. 10 shows Bode diagrams representative of open-loop transfer functions from a target position to the surface position of the subject of drive inclusive of the controller of an inside feedback loop.

FIG. 10 shows Bode diagrams representative of open-loop transfer characteristics from the target position to the surface position of the subject of drive inclusive of an inside feedback loop controller. As shown, when the cross frequency Wcd and resonance frequency Wpd are 30 Hz (188 rad/sec) and 25 Hz (157 rad/sec), respectively, a cross frequency Wcs is 5 Hz (31 rad/sec) which is far lower than the resonance frequency Ppd of 25 Hz of the belt 101, realizing stable control. If the cross frequency Wcd is higher than the cross frequency Wcs, then rapid-response control is achievable with the inside feedback loop. Further, the slope of the cross frequency Wcs is provided with an integration characteristic of −20 db/oct in order to implement stable position control.

Figure 11:
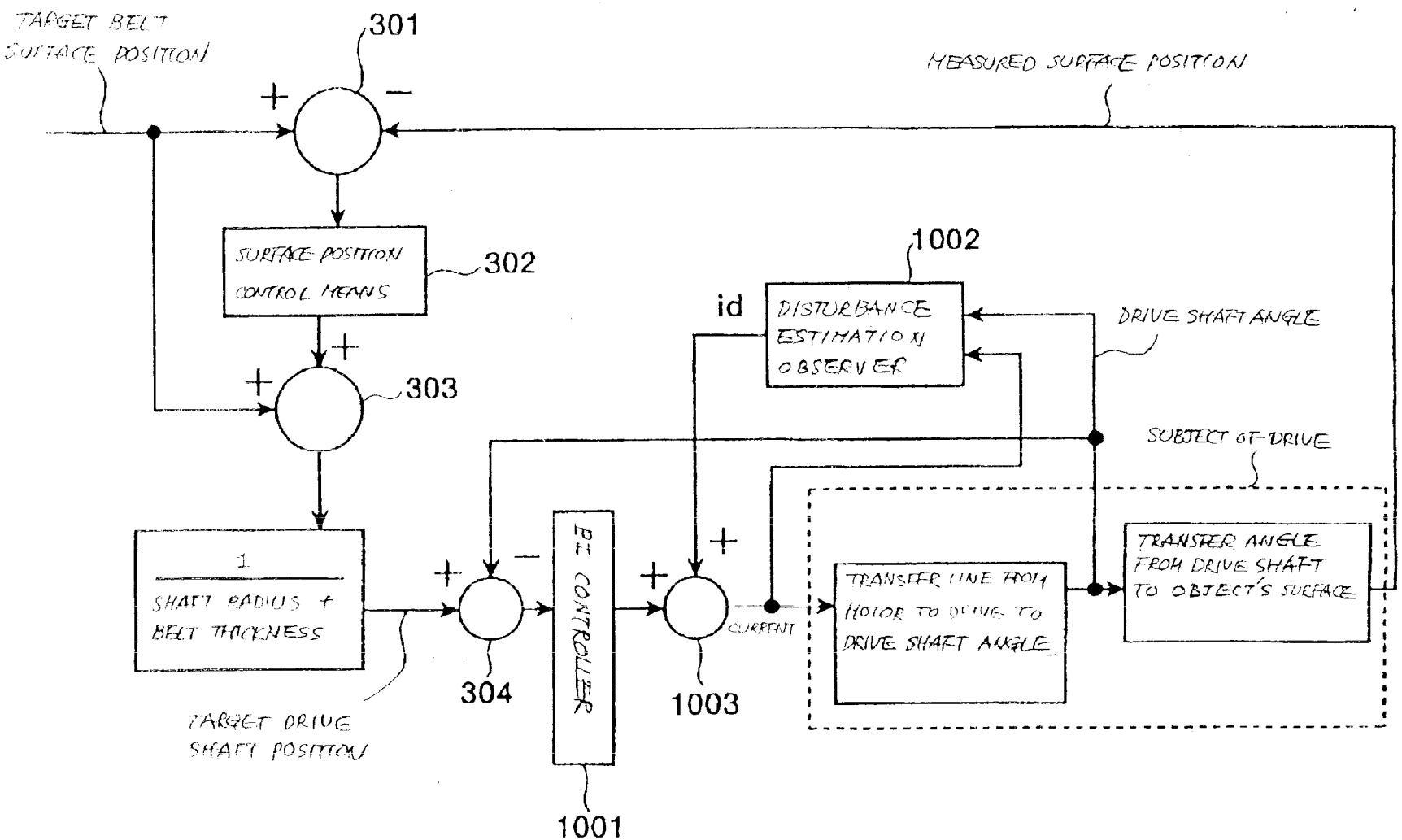
FIG. 11 is a schematic block diagram demonstrating position control representative of a fourth embodiment of the present invention.

FIG. 11 shows position control representative of a fourth embodiment of the present invention. As shown, the fourth embodiment includes, in addition to the structural elements shown in FIG. 4, a PI controller 1001 substituted for the position control means 305 and a disturbance estimation observer 1002. The PI controller 101 produces. a difference between the target drive shaft position or angle and the drive shaft angle, which are compared by the comparing means 304. The PI controller 101 then feeds the difference to the belt motor 106 in the form of a current. At this instant, adding means 103 adds the above current to the output of the disturbance estimation observer 1002 and feeds the resulting sum to the subject of drive, causing the subject of drive to move while following the target position.

More specifically, the disturbance estimation observer 1002 estimates the amount of acceleration disturbance in accordance with the drive shaft angle and the output of the adding means 103. The observer 1002 then converts the estimated amount to an estimated motor disturbance current id and feeds the current id to the adding means 1003.

The PI controller 1001 for controlling the drive shaft 102 has a transfer function PICON(S) expressed as:

$$PICON(S)=(T11+S+1)/(T12*S+1)*btgac*bhcf2*bhcf2 \quad \text{Eq. (1)}$$

$$T11=1/(Wcd/sqrt(10)) \quad \text{Eq. (2)}$$

$$T12=1/(Wcd*sqrt(10)) \quad \text{Eq. (3)}$$

$$bhcf2=1/(S/(Wcd*4)+1) \quad \text{Eq. (4)}$$

$$btgac=1/abs(T11*j*Wcd+1)*abs(T12*j*Wcd+1)*abs(btJt*btgear/btkt*j*Wced*j*Wcd \quad \text{Eq. (5)}$$

where S denotes a Laplace operator, sqrt( ) denotes the square root of ( ), abs( ) denotes the absolute value of j denotes sqrt(−1), btJt denotes the inertia moment in terms of the motor shaft to be driven, btgear denotes the number of teeth of the motor shaft pulley and drive shaft pulley, and btkt denotes the torque constant of the motor. In the illustrative embodiment, Wcd is 30 Hz (188 rad/sec), btJt is 1.578*10−4, btgear is 4, and btkt is 0.078.

The open-loop transfer characteristics shown in FIG. 9 apply to the portion extending from the target drive shaft angle to the drive shaft angle inclusive of the controller PICON(S) stated above. The cross frequency Wcd is 30 Hz (188 rad/sec); the slope is −40 dB/oct at 10 Hz and below, −40 dB/oct from 90 Hz to 120 Hz, and −80 dB/oct at 120 Hz and above. By lowering the gain of the high frequency range, the illustrative embodiment obviates the instability of the line based on the natural frequency (resonance frequency) of 120 Hz (754 rad/sec) particular to the transmission line that extends from the motor torque to the drive shaft.

The disturbance estimation observer 1002 will be described more specifically hereinafter. Assuming that disturbance is acceleration disturbance, then Eqs. (6) and (7) shown below represent the state of the subject of drive, which is included in the timing belt system, inclusive of the acceleration disturbance:

$$\begin{pmatrix} dv/dt \\ dx/dt \\ dw/dt \end{pmatrix} = \begin{pmatrix} 0 & 0 & 1 \\ 1 & 0 & 0 \\ 0 & 0 & 0 \end{pmatrix} \begin{pmatrix} v \\ x \\ w \end{pmatrix} + \begin{pmatrix} btkt/btjt/btgear \\ 0 \\ 0 \end{pmatrix} i \quad \text{Eq. (6)}$$

$$y = (0 \quad 1 \quad 0) \begin{pmatrix} v \\ x \\ w \end{pmatrix} \quad \text{Eq. (7)}$$

where v denotes a velocity, x denotes a drive shaft angle, w denotes acceleration disturbance, and i denotes a motor current.

The minimum-order observer is determined by use of a canonical equation. Assuming that the poles of the observer γ1 and γ2 are −300 and −299, respectively, then the state of the minimum-order disturbance observer is expressed as:

$$\begin{pmatrix} dw1/dt \\ dw2/dt \end{pmatrix} = \begin{pmatrix} -559 & 1 \\ -89700 & 0 \end{pmatrix} \begin{pmatrix} w1 \\ w2 \end{pmatrix} + \begin{pmatrix} -269100 & btkt/btjt/btgear \\ -53730300 & 0 \end{pmatrix} \begin{pmatrix} x \\ i \end{pmatrix} \quad \text{Eq. (8)}$$

$$\begin{pmatrix} \hat{x}1 \\ \hat{x}2 \\ \hat{x}3 \end{pmatrix} = \begin{pmatrix} 1 & 0 \\ 0 & 0 \\ 0 & 1 \end{pmatrix} \begin{pmatrix} w1 \\ w2 \end{pmatrix} + \begin{pmatrix} 599 & 0 \\ 1 & 0 \\ 89700 & 0 \end{pmatrix} \begin{pmatrix} x \\ i \end{pmatrix} \quad \text{Eq. (9)}$$

where $\hat{x}1$ denotes a velocity, $\hat{x}2$ denotes a drive shaft angle, and $\hat{x}3$ denotes estimated acceleration disturbance.

The estimated acceleration disturbance $\hat{x}3$ is converted to an estimated motor disturbance current id by:

$$id=/(btkt/btjt/begear)\times 3 \quad \text{Eq. (10)}$$

Figure 12A:
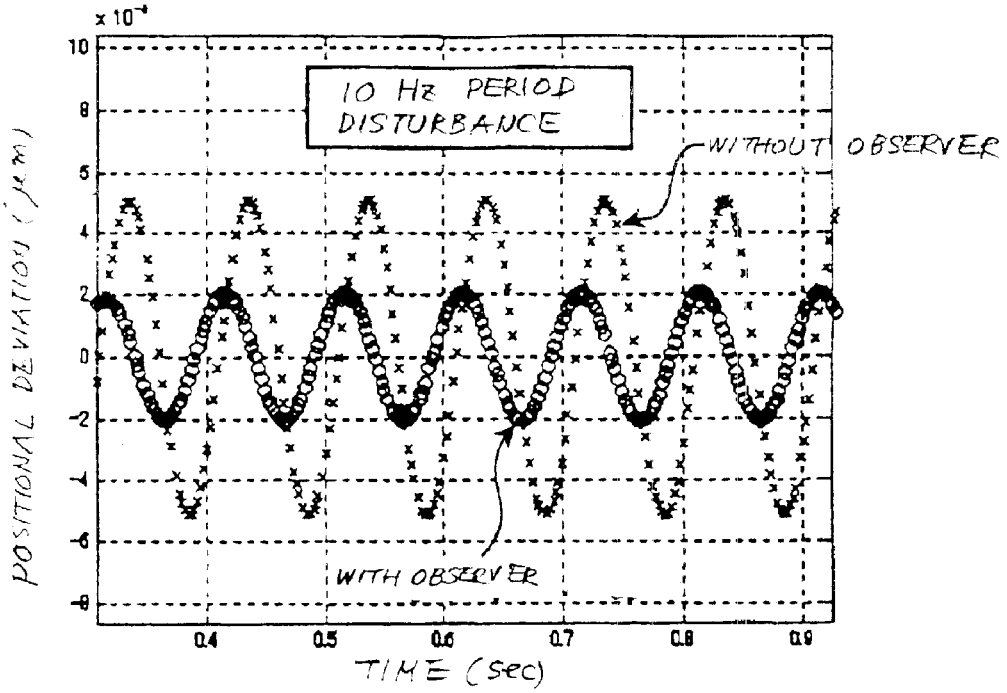
FIGS. 12A and 12B are graphs comparing a case with a disturbance estimation observer and a case without it as to positional deviation.
Figure 12B:
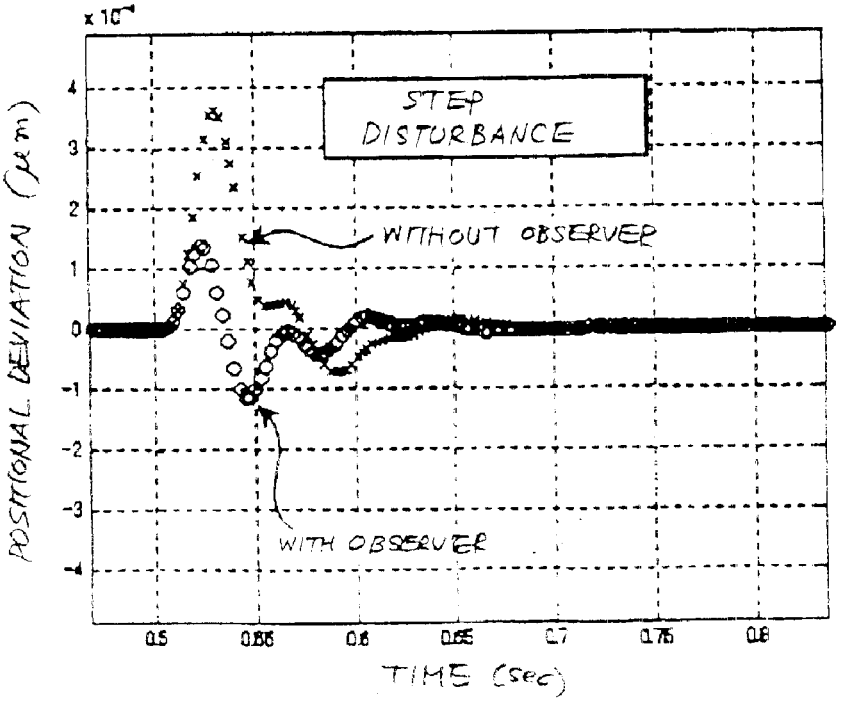

With the above procedure, the disturbance estimation observer. 1002 produces the estimated motor disturbance current from the drive shaft angle and motor current and feeds back the estimated current to the adding means 1003. FIGS. 12A and 12B compare the case with the disturbance estimation observer 1002 and the case without it as to positional deviation. In FIGS. 12A and 12B, the ordinate and abscissa indicate time (sec) and positional deviation (μm). When 10 Hz period disturbance occurs, the positional deviation is as great as −50 μm to +50 μm in the case without the observer 1002, but is as small as −20 μm to 20 μm in the case with the observer 1002, meaning that the positional deviation is reduced to ⅖. As for step disturbance, there can be reduced overshoot.

Figure 13:
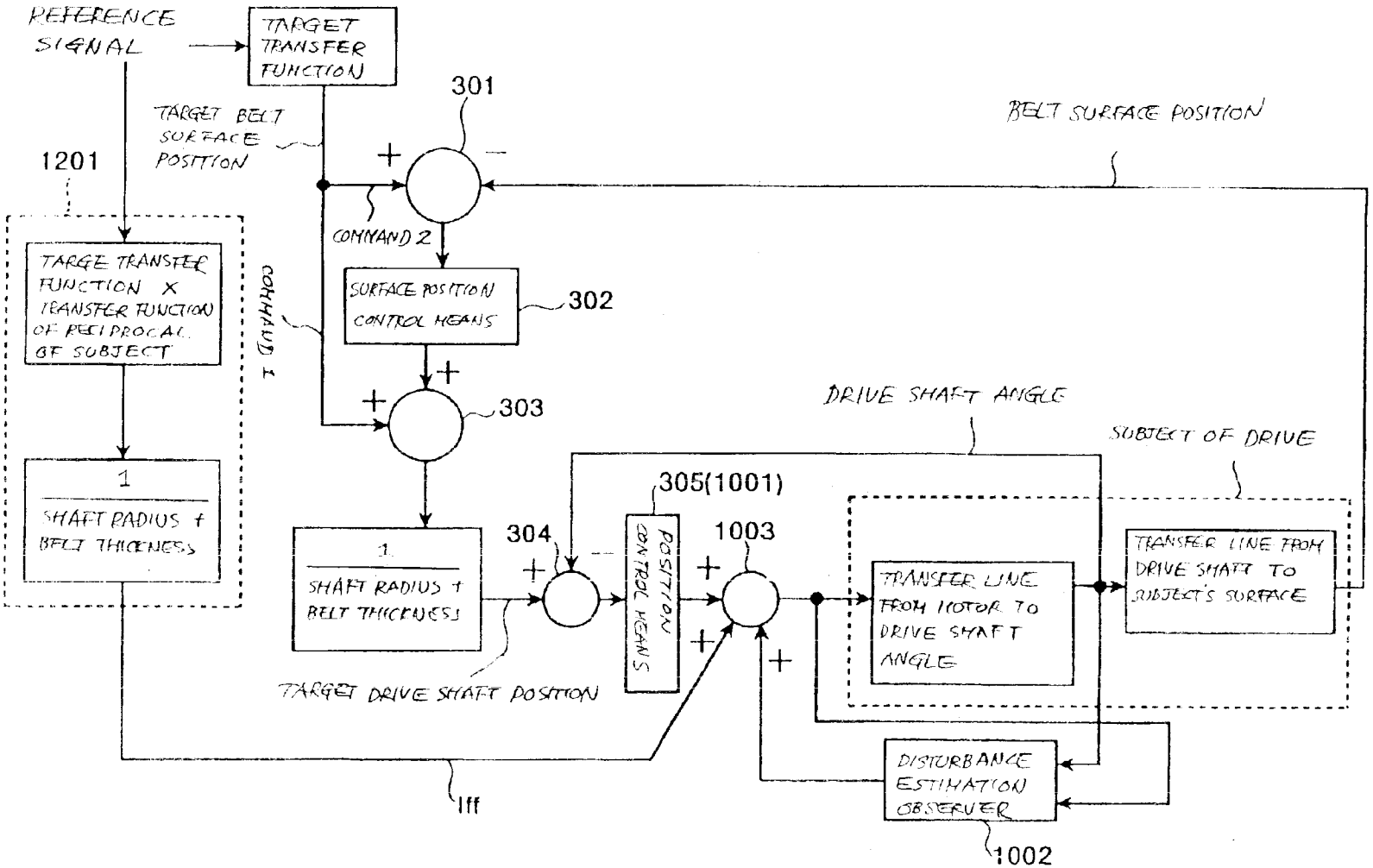
FIG. 13 is a schematic block diagram demonstrating positional control representative of a fifth embodiment of the present invention.

FIG. 13 demonstrates position control representative of a fifth embodiment of the present invention. As shown, the fifth embodiment includes a feed-forward circuit 1201 in addition to the configuration of FIG. 11. In FIG. 13, a reference signal Refposi(s) is the ramp function of Refposi (s)=vref/s where s denotes a Laplace operator.

A target transfer function Gref(s) is expressed as:

$$Gref(s)=1/(a3*sigma3*s3+a2*sigma2*s2+al*sigma*s+1) \quad \text{Eq. (11)}$$

$$sigma=0.095*2 \quad \text{Eq. (12)}$$

$$alpha=0.2*2 \quad \text{Eq. (13)}$$

$$al=(1-alpha)+alpha \quad \text{Eq. (14)}$$

$$a2=(1-alpha)*0.3333+alpha*0.3786 \quad \text{Eq. (15)}$$

$$a3=(1-alpha)*0.003704+alpha*0.1006 \quad \text{Eq. (16)}$$

The transfer function Gnom(s) of the subject of control except for an oscillation term is produced by:

$$Gnom(s)=btkt*1/btJt*1/btgear*1/s2 \quad \text{Eq. (17)}$$

In FIG. 13, a feed-forward current Iff is produced by:

$$Iff=Refpos(s)*Gref(s)/Gnom(s)/(\text{shaft radius+belt thickness}) \quad \text{Eq. (18)}$$

Figure 14:
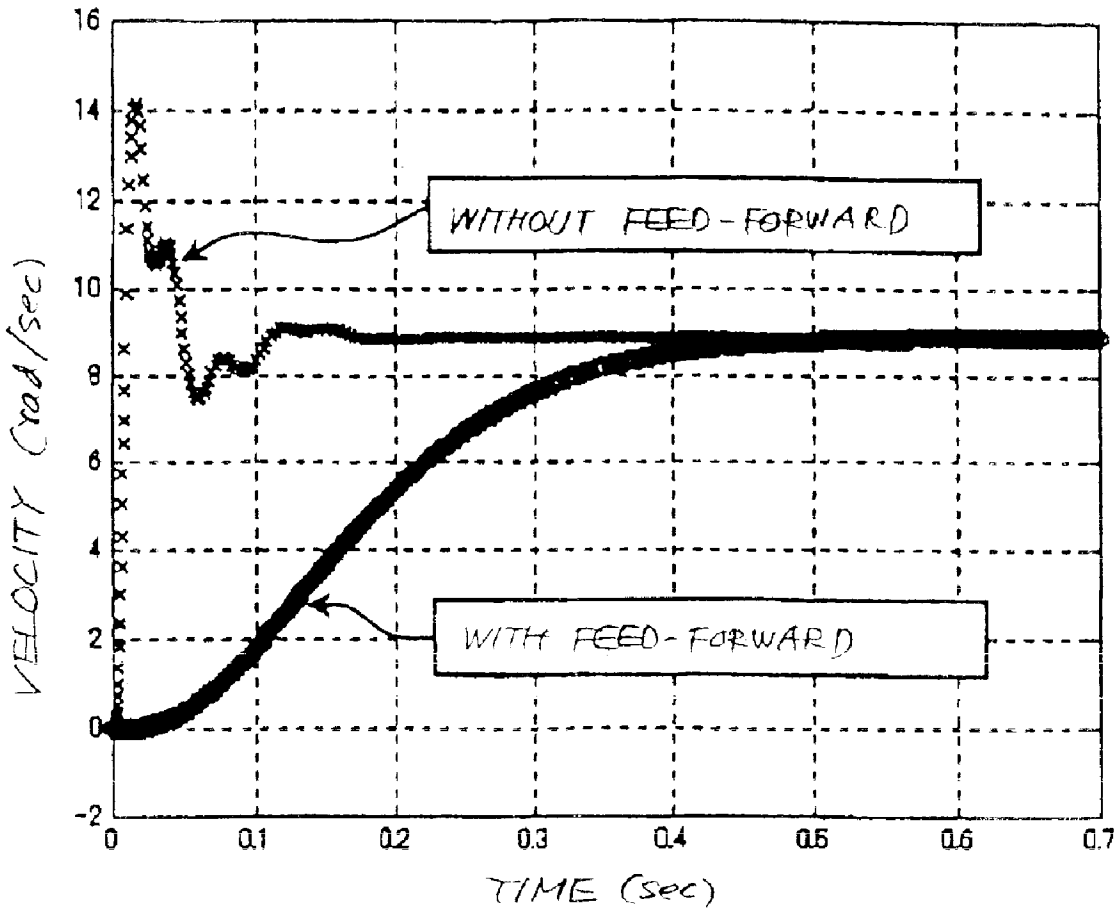
FIG. 14 is a graph comparing a case with a feed-forward circuit and a case without it as to the velocity of a drive shaft at the beginning of movement of the belt.

FIG. 14 compares the case with the feed-forward circuit 1201 and the case without it as to drive shaft velocity. In FIG. 14, the ordinate and abscissa indicate time (sec) and velocity (rad/sec), respectively. As shown, the feed-forward circuit 1201 allows the drive shaft to smoothly reach the target speed without any overshoot, thereby reducing oscillation.

Figure 15:
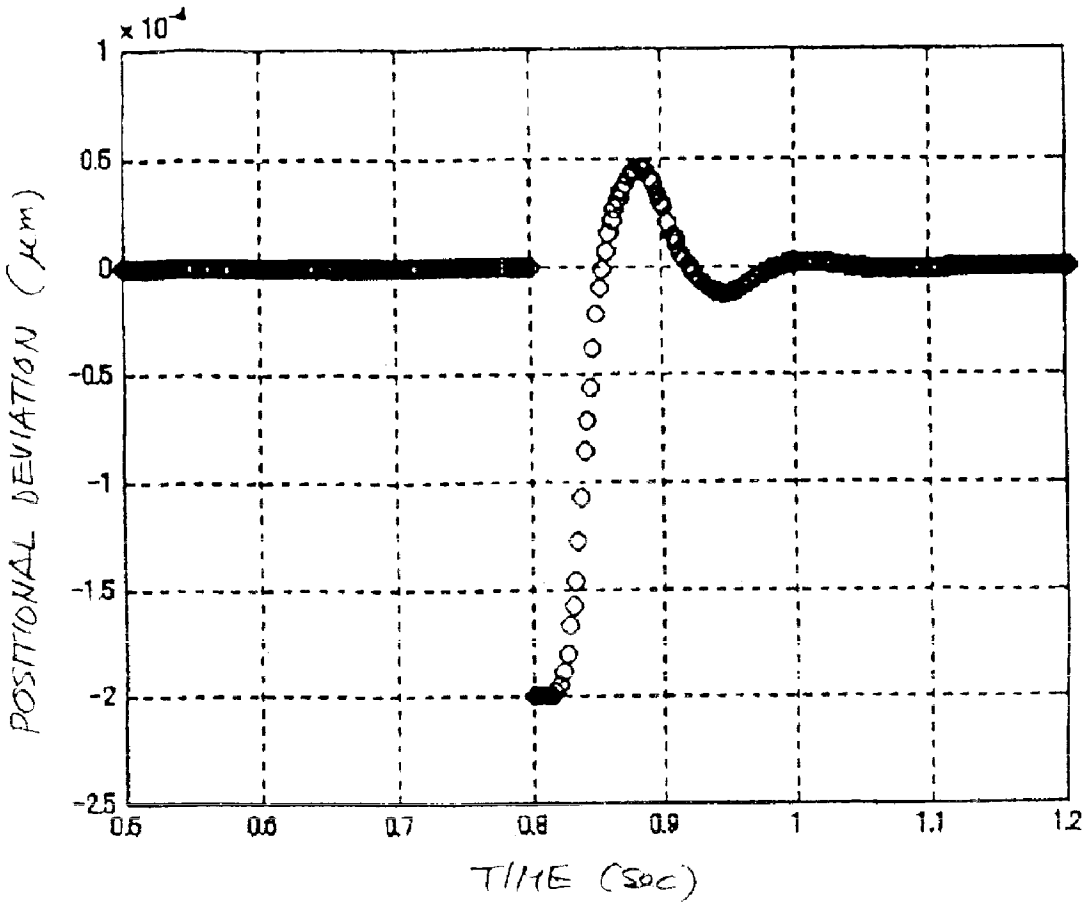
FIG. 15 is a graph showing the result of belt slip in relation to the transfer characteristic of FIG. 10.

FIG. 15 shows a relation between the time (sec) and the positional deviation ($\mu$m) determined when the belt 101 slipped in the conditions of FIG. 10, i.e., when the drive shaft 102 and the surface position of the belt 101 were subject to feedback control. Assume that the belt 101 slips by about 200 $\mu$m. Then, although the position is deviated in 0.8 second, but the deviation is substantially fully canceled in 0.2 second since the deviation. In this manner, the illustrative embodiment monitors the shift of the surface position for thereby achieving the feedback effect.

Figure 16:
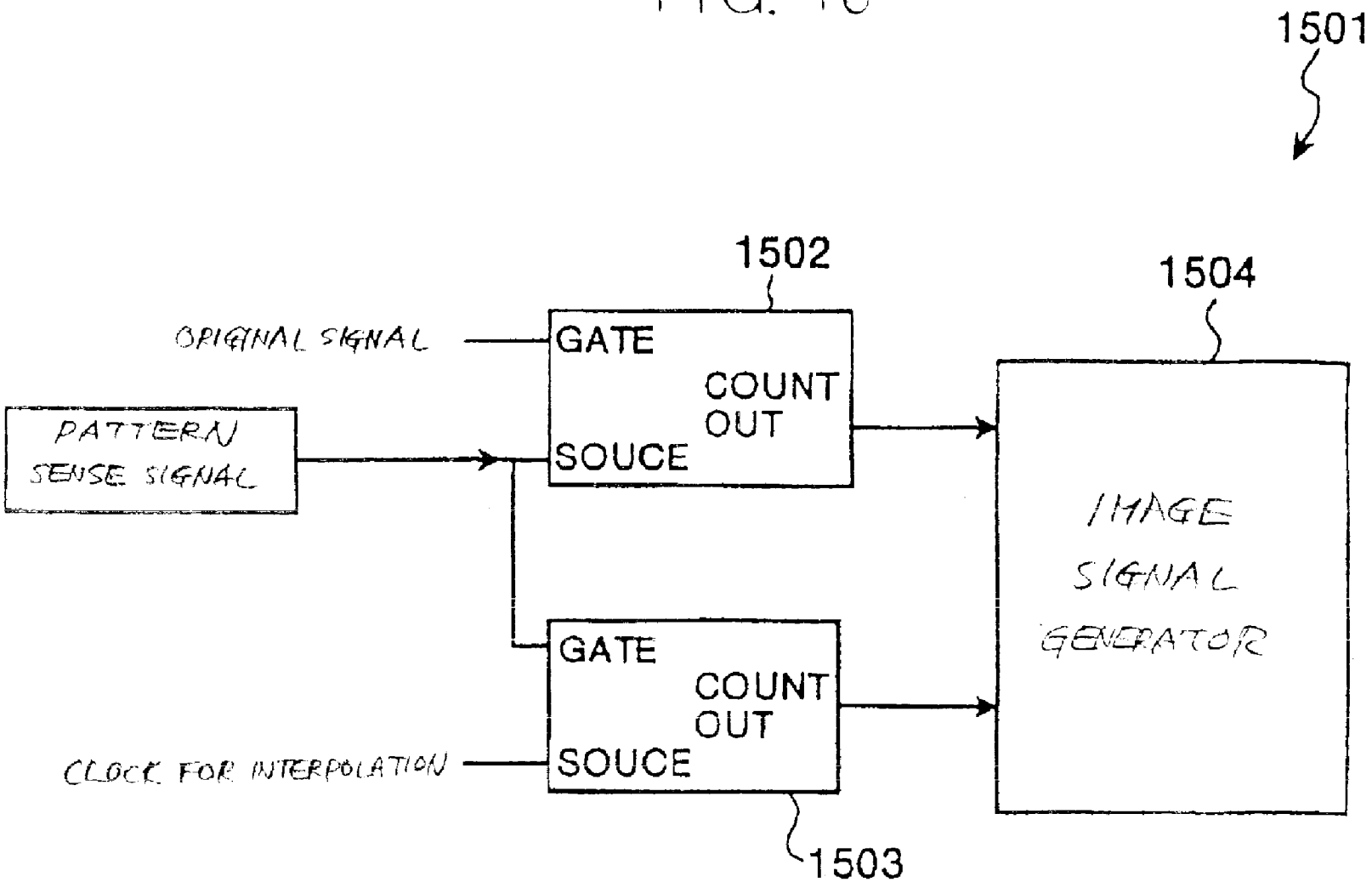
FIG. 16 is a schematic block diagram showing a signal interpolation circuit representative of a sixth embodiment of the present invention.

FIG. 16 shows a signal interpolating circuit representative of a sixth embodiment of the present invention. As shown, the signal interpolating circuit, generally 1501, interpolates a clock with a preselected period in pulses output from the optical head or sensor 108. The signal interpolating circuit 1501 may be implemented as a counter configured to count a reference clock shorter in period than the pattern sense signal by being triggered by the edge of the pattern sense signal. The count of the pattern sense signals output from the optical head or sensor 108 and the count of the signal interpolate signals output from the signal interpolating circuit 1501 are input to the microcomputer 201, FIG. 3. The microcomputer 201 calculates the position of the belt 101 at the time when it received the above two counts.

A feedback system using, e.g., a general encoder produces a position or an angle from a count at the time when a controller read a count with an encoder counter, and compares it with a target value however, the count of the counter has uncertainty corresponding to the pulse period and makes control unstable; for example, the maximum error with a pulse period of 0.1 mm mounts to 0.1 mm. The illustrative embodiment uses a clock corresponding to a period of, e.g., 0.01 mm and effects interpolation by considering that the pattern signal period is constant. With this scheme, it is possible to make the position sensing error as small as speed variation.

Position control using the signal interpolating circuit 1501 will be described hereinafter. The signal interpolating circuit 1501 is made up of a pattern signal counter 1502 and a clock counter 1503 each of which may be implemented by a general counter having a gate input and a source input. Counts output from the two counters 1502 and 1503 are input to an image signal generator 1504.

The pattern signal counter 1502 receives via its gate either one of an origin signal, which appears every time the belt 101 makes one turn (i.e. every time the optical head 108 senses the encoder scale 107) and a signal output from the apparatus body. Such a signal triggers the counter 1502 as to counting operation. The pattern sense signal is input to the source of the counter 1502. The pattern sense signal and an interpolation clock are respectively input to the source and gate of the clock counter 1503.

In the above configuration, the pattern distance may be 0.1 mm while the pattern signal may have a frequency of about 1 kHz and varies by about 1% due to speed variation. The interpolation clock has a frequency of 100 kHz. In the event of motor control, a loop consisting of the input of counter data, inside calculation and motor drive output is executed, so that the reading of counter data varies in accordance with the processing speed.

For example, when the count of the pattern signal counter 1502 is "10", it is probable that the position is 1 mm to 1.1 mm. At this instant, assume that the count of the clock counter 1503 is "50". Then, as for motor control, by using a mean velocity of 100 mm/sec, it is determined that the count of the clock counter represented by 100 (mm/sec)×50 (count)/100 (kHz) is 0.05 mm. The overall position is therefore determined to be 1.05 mm. If the variation of the mean velocity is 1%, then the error of the clock counter is also 1% or below, so that the error is between 0.0499 mm to 0.0501 mm. In this manner, highly accurate sensing is achievable.

Figure 17:
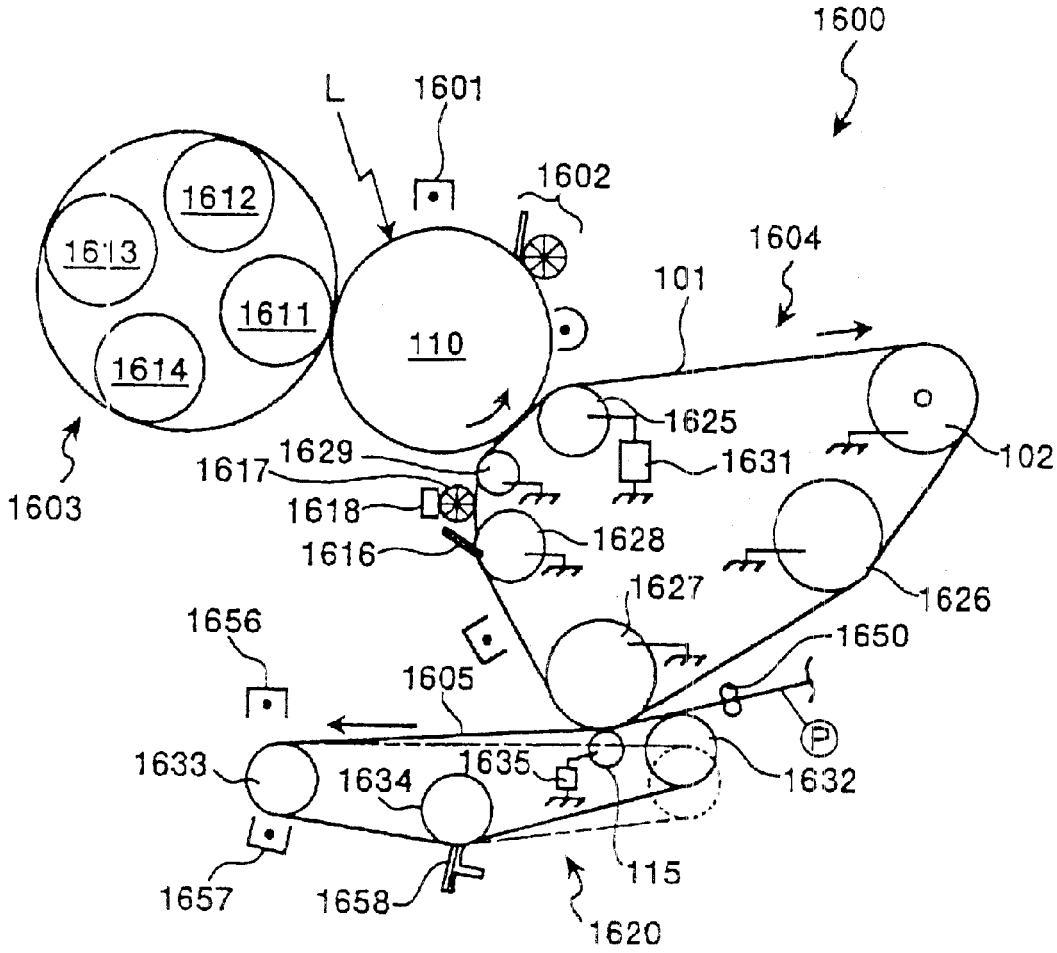
FIG. 17 is a view showing a specific configuration of an image forming section included in a color image forming apparatus of the type including the intermediate image transfer belt.

Reference will be made to FIG. 17 for describing a color copier, color printer or similar color image forming apparatus (color copier hereinafter) including the intermediate image transfer belt 101 described in relation to the illustrative embodiments. As shown, the color copier includes an image forming section 1600 as well as other conventional sections, not shown, including a color scanner or image reading section, a sheet feeding section, and a control section. The color scanner reads image data out of a document in the form of separated color components, e.g., an R (red), a G (green) and a B (blue) components and converts them to electric, color image signals. An image processing section, not shown, transforms the R, G and G image signals to Bk (black), C (cyan), M (magenta) and Y (yellow) image data on the basis of signal strength level.

The image forming section 17 includes the drum or image carrier 110, a charger or charging means 1601, and a cleaning device 1602 including a cleaning blade and a fur brush. The image forming section 17 further includes an optical writing unit or exposing means, not shown, a revolver type developing unit or developing means (revolver hereinafter) 1603, an intermediate image transfer unit 1604, a secondary image transfer unit 1620, and a fixing unit, not shown, using a pair of rollers.

The drum 110 is rotatable counterclockwise, as indicated by an arrow in FIG. 17. Arranged around the drum 110 are the charger 1601, cleaning device 1602, designated one of developing sections forming the revolver 1603, and belt 101 included in the intermediate image transfer unit 1604. The optical writing unit converts the color image data output from the color scanner to an optical signal and scans the surface of the drum 110, which is uniformly charged by the charger 1601, with a laser beam L, thereby forming a latent image on the drum 110. The optical writing unit may include a semiconductor laser or light source, a laser driver, a polygonal mirror, a motor for driving the mirror, an f/θ lens and mirrors, although not shown specifically.

The revolver 1603 includes a Bk developing section 1611 using Bk toner, a C developing section 1612 using C toner, an M developing section 1613 using M toner, and a Y developing section 1614 using Y toner. A drive section, not shown, causes the revolver 1603 to bodily rotate counterclockwise, as viewed in FIG. 17. The developing sections 1611 through 1614 each include a sleeve or developer carrier, a paddle, and a drive section. The sleeve is caused to rotate clockwise, as viewed in FIG. 17, by the drive section with a developer layer formed thereon contacting the drum 110. The paddle is rotated to scoop up a developer to the sleeve while agitating it.

The developer is made up of toner grains and carrier grains formed of ferrite and. The toner grains are charged to negative polarity by being agitated together with the carrier grains. A bias power supply or bias applying means, not shown, applies a negative DC voltage Vdc biased by an AC voltage Vac to the sleeve. As a result, the sleeve is biased to a preselected voltage relative to the metallic core of the drum 110.

While the color copier is in a stand-by state, the revolver 1603 remains stationary at its home position with the Bk developing section 1611 facing the drum 110 at a developing position. When the operator of the copier presses a copy start key, the copier starts reading image data out of a document. The optical writing unit scans the charged surface of the drum 110 with the laser beam in accordance with the resulting color image data, thereby forming a latent image on the drum 110. Let the latent image derived from Bk image data be referred to as a Bk latent image. This is also true with the other colors C, M and Y.

The sleeve of the Bk developing section is caused start rotating before the leading edge of the Bk latent image arrives at the developing position, so that the Bk latent image is developed by the Bk toner. As soon as the trailing edge of the Bk latent image moves away from the developing position, the revolver 1603 is rotated to locate the next developing section at the developing position. This rotation is completed at least before the leading edge of a latent image derived from the next image data arrives at the developing position.

In the intermediate image transfer belt 1604, the belt 101 is passed over a plurality of rollers stated earlier. A secondary image transfer belt or sheet carrier 1605 included in the secondary image transfer unit 1620 is positioned adjacent the belt 101. Also arranged around the belt 101 are a bias roller or secondary image transfer roller 115 for secondary image transfer, a belt cleaning blade or belt cleaning means 1616, and a lubricant coating brush or coating means 1617.

More specifically, the belt 101 is passed over a bias roller or primary image transfer charge applying means 1625 for primary image transfer, a belt drive roller (drive shaft stated earlier) 102, a belt tension roller 1626, a back roller 1627, a back roller 1628, and a ground roller 1629. These rollers are formed of a conductive material and are connected ground except for the bias roller 1625 for primary image transfer.

A power supply 1631 for primary image is subject to constant-current or constant-voltage control and applies a bias controlled to a preselected current or a preselected voltage in accordance with the number of toner images to be superposed on each other to the bias roller 1625. The belt motor 106, FIG. 2, causes the belt 101 to move in a direction indicated by an arrow in FIG. 17 via the timing pulley 103 and timing belt 104. The belt 101 is formed with a semiconductor or an insulator and provided with a single layer or a multiple layer structure.

In an image transfer position where a toner image is to be transferred from the drum 110 to the belt 101, the belt 101 is pressed against the drum 110 by the bias roller 1625 and ground roller 1629, forming a nip between the belt 101 and the drum 110 over a preselected width.

The lubricant coating brush 1617 shaves a flat block of zinc stearate 1618, which is a lubricant, and coats the resulting fine grains on the belt 101. The brush 1617 is moved into contact with the belt 101 at an adequate timing.

In the secondary image transfer unit 1620, the belt 1605 is passed over three support rollers 1632, 1633 and 1634. Part of the belt 1605 extending between the support rollers 1632 and 1633 is pressed against the back roller 1627 at an adequate timing. Drive means, not shown, causes the belt 1605 to move in a direction indicated by an arrow in FIG. 17 via one of the support rollers 1632 through 1634.

The bias roller or secondary image transferring means 115 nip the belts 101 and 1605 between it and the back roller 1627. A constant-current power supply 1635 for secondary image transfer applies a preselected bias to the bias roller 115 in the from of a preselected current. A moving mechanism, not shown, selectively move the belt 1605 and bias roller 115 into or out of contact with the back roller 1627. In FIG. 17, the belt 1605 and support roller 1632 moved away from the back roller 1627 are indicated by phantom lines.

A sheet or recording medium P is fed from the sheet feeding section to a registration roller pair 1650 and stopped for a moment thereby. The registration roller pair 1650 starts conveying the sheet P toward the nip between the belts 101 and 1605 at a preselected timing. A sheet discharger or medium discharging means 1656 and a belt discharger or medium carrier discharging means 1657 face the portion of the belt 1605 passed over the support roller 1633, which adjoins the roller pair of the fixing unit. Further, a cleaning blade or medium carrier cleaning means 1658 is held in contact with the portion of the belt 1605 passed over the support roller 1634.

The sheet discharger 1658 discharges the sheet P for thereby allowing the sheet P to easily part from the belt 1605 due to its own flexibility. The belt discharger 1657 removes charge left on the belt 1605. The cleaning blade 1658 removes deposits from the surface of the belt 1605.

In operation, at the beginning of an image forming cycle, the drum motor 113, FIG. 2, causes the drum 110 to start counterclockwise, as viewed in FIG. 17. At the same time, the belt drive roller or drive shaft 102 causes the belt 101 to turn clockwise, as viewed in FIG. 17. In this condition, a Bk, a C, an M and a Y toner image sequentially formed on the drum 110 are sequentially transferred to the belt 101 one above the other by the voltage applied to the bias roller 1625, completing a full-color toner image on the belt 101.

The Bk toner image, for example, is formed by the following procedure. The charger 1601 uniformly charges the surface of the drum 110 to a preselected potential with negative charge. The optical writing unit scans the charged surface of the drum 110 with the laser beam L in accordance with Bk color image data. As a result, the charge deposited on the drum 110 disappears in the exposed portion in proportion to the quantity of incident light, forming a Bk latent image.

The Bk toner charged to negative polarity and deposited on the sleeve of the Bk developing section 1611 contacts the Bk latent image, forming a corresponding Bk toner image. The Bk toner image is then transferred from the drum 110 to the surface of the belt 101, which is moving in contact with and at the same speed as the drum 110. This is the primary image transfer. The cleaning device 1602 removes the toner left on the drum 110 after the primary image transfer for thereby preparing it for the next image forming cycle. Subsequently, the optical writing unit scans the drum 110 with the laser beam L in accordance with C color image data to thereby form a C latent image on the drum 110.

After the trailing edge of the Bk latent image has moved away from the developing position, but before the leading edge of the C latent image arrives at the developing position, the revolver 1603 is rotated to locate the C developing section 1612 at the developing position for thereby developing the C latent image with the C toner. As soon as the trailing edge of the C latent image moves away from the developing position, the revolver 1603 is again rotated to locate the M developing section 1613 at the developing position. This rotation is also completed before the leading edge of an M latent image arrives at the developing position. An M and a Y toner image are formed in exactly the same manner as the Bk and C toner images and will not be described specifically in order to avoid redundancy.

The Bk, C, M and Y toner images thus sequentially formed on the drum 110 are transferred to the same portion of the belt 101 one above the other, completing a full-color image on the belt 101. Of course, the number of toner images of different color may be three or less.

At the time when the image forming cycle begins, a sheet P is fed from the sheet feeding section, e.g., a cassette or a manual feed tray to the registration roller pair 1650 and stopped thereby. The registration roller pair 1650 conveys the sheet P toward the nip between the bias roller 115 and the back roller 1627 (secondary image transfer position) such that the leading edge of the sheet P meets the leading edge of the toner image carried on the belt 101.

When the sheet P is conveyed via the secondary image transfer position while underlying the toner image carried on the belt 101, the bias roller 115 applied with the bias from the power supply 1635 transfers the toner image from the belt 101 to the sheet P. This is the secondary image transfer. Subsequently, the sheet discharger 1656 discharges the sheet P with the result that the sheet P is separated from the belt 1605. The sheet P is then conveyed to the fixing unit. The fixing unit fixes the toner image on the sheet P with the roller pair. Finally, the sheet or copy P is driven out of the copier body to a copy tray not shown.

The cleaning device 1602 cleans the surface of the drum 110 after the primary image transfer. Subsequently, a quenching lamp, not shown, discharges the surface of the drum 110. Also, the belt cleaning blade 1616 is moved into contact with the belt 101 to remove the toner left on the belt 101 after the secondary image transfer.

In a repeat copy mode, after the first Y or fourth-color toner image has been formed, the color scanner and drum 10 are operated to start forming the second Bk or first-color toner image at a preselected timing. Also, the belt 101 is operated such that after the secondary image transfer of the first full-color toner image, the second Bk toner image is transferred to the portion of the belt 101 cleaned by the belt cleaning blade 1616.

While the foregoing description has concentrated on a full-color mode, the procedure described above will be repeated, in a tricolor or a bicolor mode, a number of times corresponding to the number of colors and the number of desired copies designated. Ina monochromatic mode, until a desired number of copies have been output, only one of the developing sections of the revolver 1603 corresponding to desired color is continuously operated while the belt cleaning blade 1616 is held in contact with the belt 101.

Figure 18:
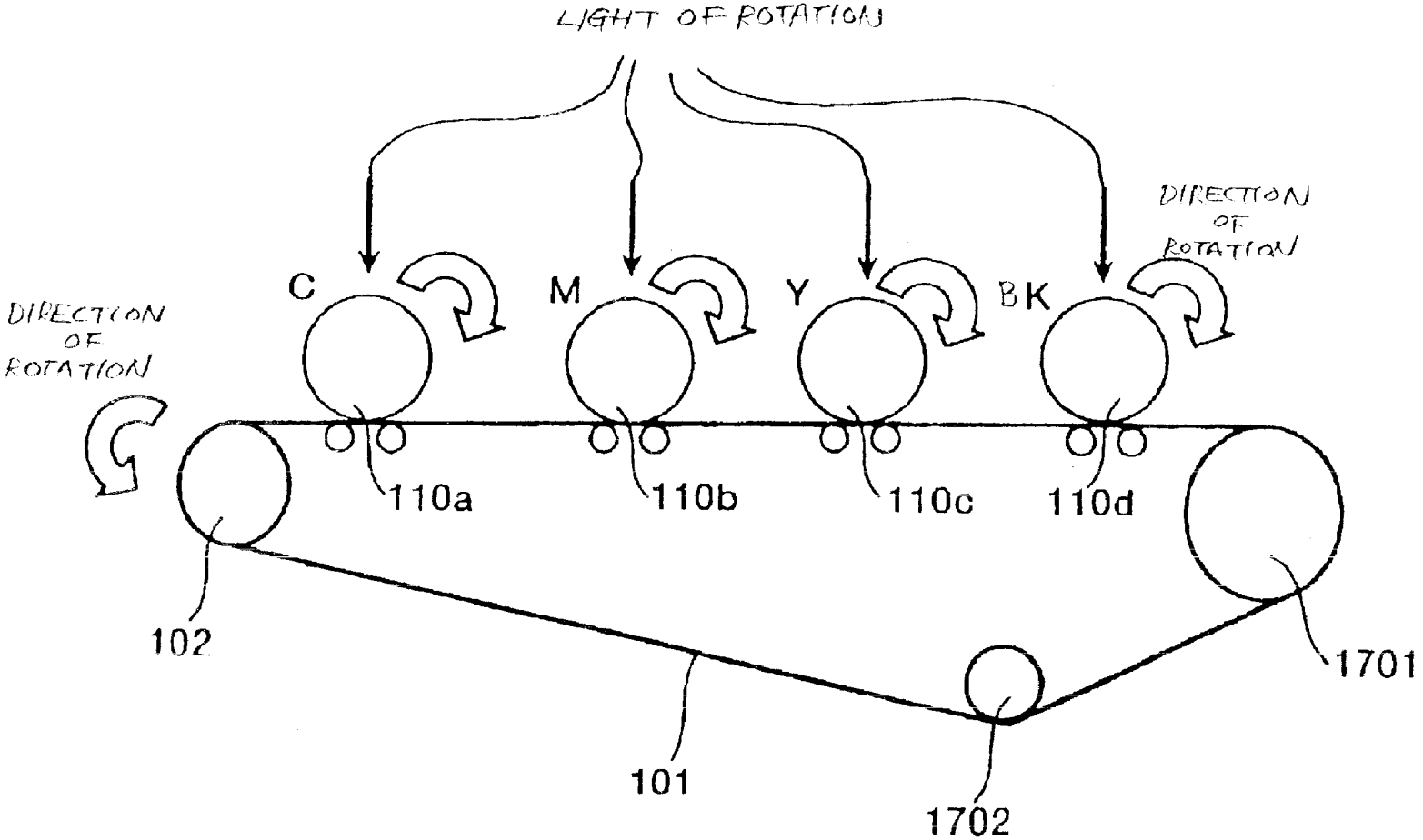
FIG. 18 is a view showing a specific configuration of a tandem image forming apparatus.

FIG. 18 shows a specific configuration of a tandem image forming apparatus. As shown, the belt 101 is passed over the drive roller or drive shaft 102, a driven roller 1701, and a tension roller 1702. Four photoconductive drums 110*a*, 110*b*, 110*c* and 110*d* are positioned side by side along the upper run of the belt 101 and assigned to the colors C, M, Y and Bk, respectively. The drums 110*a* through 110*d* each are driven by a respective motor via a respective transmission mechanism, although not shown specifically. The belt 101 and an optical writing position assigned to each of the drums 110*a* through 110*d* are symmetrical to each other with respect to the axis of the drum.

When the movement control stated earlier is effected with the tandem image forming apparatus shown in FIG. 18, accurate position control is also achievable and insures high-quality color images free from color shift.

The movement control of the illustrative embodiment can be effected if a program prepared beforehand is executed by a personal computer, work station or similar computer. The program is stored in a hard disk, floppy (R) disk, CD (Compact Disk)-ROM, MO (Magnet Optical) disk, DVD (Digital Versatile Disk) or similar recording medium capable of being read by a computer. If desired, the program may be distributed from the recording medium via Internet or similar network.

In summary, it will be seen that the present invention provides a belt moving device and an image forming apparatus including the same having various unprecedented advantages, as enumerated below.

(1) When a belt slips on a drive shaft and is shifted from a target position, the belt moving device senses the surface position of the belt and corrects the target angular position of the drive shaft by the shift of the belt, thereby returning the surface position of the belt to a correct position. This is also true when the belt is shifted from the target position due to the eccentricity of the drive shaft.

(2) When the belt has low rigidity, response frequency for position control is lowered to obviate resonance. As for a driveline extending from a motor more rigid than the belt to the drive shaft, response frequency is raised to execute position control that cancels the eccentricity disturbance of various shafts. First and second correcting means deal with the shift of the belt and the other disturbance, respectively, thereby reducing the shift of the belt from the target position.

(3) The rigidity of the belt is increase the resonance frequency of the belt, so that the surface position of the belt with a broader control band is directly subject to feedback control. This is also successful to reduce the shift of the belt from the target position.

(4) The rotation state of a motor shaft is fed back to correct the eccentricity or similar mechanical error of a drive transfer line extending from the motor shaft to the drive shaft position and the error of a drive transfer line extending from the drive shaft to the belt surface position. Further, when the belt and drive roller slip on each other, the above feedback allows the target angular position of the motor shaft to be corrected by the shift of the belt in accordance with the sensed surface position of the belt. The belt can therefore be returned on its correct position.

(5) The belt and drive shaft are formed with teeth meshing with each other. This is also successful to reduce the shift of the belt from the target position.

(6) An image forming apparatus is free from positional shift during image formation and therefore performs highly accurate image formation.

(7) Assume that rigidity from torque generated by a motor to the angle of the drive shaft is low, and that rigidity from drive shaft torque to the surface position of the belt is low, i.e., that resonance frequency from the motor output torque to the drive shaft angle is higher than resonance frequency from the drive shaft torque to the surface position of the belt. In such a case, it is possible to raise the cross frequency Wcd of open-loop transfer characteristics from the target drive shaft angle to the drive shaft angle inclusive of a controller, implementing a stable, rapid response control system. In addition, the shift of the belt from the target surface position can be canceled by being added to the target drive shaft angle, so that the positional shift is reduced.

(8) Assume that rigidity from the motor output torque to the angle of the motor output shaft is low, and that rigidity from drive shaft torque to the surface position of the belt is low, i.e., that resonance frequency from the motor output torque to the motor output shaft angle inclusive of a mechanical line up to the drive shaft is higher than resonance frequency from the drive shaft torque to the surface position of the belt. In such a case, it is possible to raise the cross frequency Wcm of open-loop transfer characteristics from the target motor output shaft angle to the motor output shaft angle inclusive of a controller, implementing a stable, rapid response control system. In addition, the shift of the belt from the target surface position can be canceled by being added to the target motor output shaft angle, so that the positional shift is reduced.

(9) Even when the rigidity of the belt is high, feedback control over the belt surface position implements rapid response, stable control that obviates the shift of the belt from the target surface position.

(10) As for the target drive shaft angle, when resonance frequency from the drive shaft to the surface position of the belt is low, the gain of an outside feedback loop is lowered for thereby allowing the target drive shaft angle to be stably varied.

(11) As for the target motor output shaft angle, when the resonance frequency of a transfer line from the motor to the drive shaft or that of a transfer line from the drive shaft to the surface position of the belt is low, the gain of the outside feedback loop is lowered for thereby allowing the target motor output shaft angle to be stably varied.

(12) As for a minor loop, a PI controller executes stable position control while a disturbance estimation observer executes accurate position control by coping with disturbance that cannot be removed by position control. Therefore, by providing the slope of the cross frequency Wcs of an open-loop transfer function from the target position to the surface position of the belt (outside feedback loop) with an integration characteristic of −20 db/dec, it is possible to effect stable position control over the entire system.

(13) At the beginning of belt drive, multiplication is effected with a function that makes the target position of a ramp function smooth. This realizes position control with a minimum of overshoot and a minimum of oscillation.

(14) Oscillation ascribable to teeth is not transferred to an image forming section, so that banding and positional shift can be reduced.

(15) Noise and power consumption are reduced.

(16) Even when use is made of inexpensive marker sensing means having a broad slit pattern, high resolution and therefore accurate position control is achievable because an analog output derived from slits is digitized for interpolation.

(17) A single DSP or a single CPU is used to execute software servo. Therefore, software suffices for the calculation of a controller and an observer as and the calculation of a target value locus and a feed-forward value. This implements low cost, highly accurate positioning control without resorting to a sophisticated circuit.

(18) Software servo is used to calculate a PI controller, a disturbance estimation observer, a new target position and a feed-forward value made discrete by the sampling time. This also insures highly accurate positioning control.

(19) Even when an encoder mounted on the drive shaft or the motor output shaft becomes eccentric., the eccentricity can be corrected, so that an eccentricity error is obviated. Therefore, highly accurate position control can be effected over the drive shaft or the motor output shaft.

(20) The movement of an intermediate image transfer belt can be accurately controlled. This obviates color misregister on a sheet for thereby insuring high-quality images.

Various modifications will become possible for those skilled in the art after receiving the teachings of the present disclosure without departing from the scope thereof.

What is claimed is:

1. A device for moving a belt with an output torque of a motor, said device comprising:

a drive shaft configured to cause the belt to move;

transmitting means for transmitting the output torque of the motor to said drive shaft;

marker sensing means for sensing a marker, which is provided on the belt, to thereby determine a position of said belt in a direction of movement of said belt;

rotation condition sensing means for sensing a rotation condition of said drive shaft;

first correction information generating means for generating, based on an output of said marker sensing means, correction information for correcting the position of the belt in the direction of movement;

second correction information generating means for generating, based on an output of said rotation condition sensing means, correction information for correcting a rotation condition of said drive shaft; and control means for controlling a movement of the motor in accordance with said correction information output from said first correction information generating means and said second correction information generating means, wherein said correction information generated by said first correction information generating means has a lower maximum response frequency than said correction information generated by said second correction information generating means.

2. The device as claimed in claim 1, wherein teeth are formed on at least a single portion of said drive shaft in an axial direction of said drive shaft, and teeth are formed on the belt and held in mesh with said teeth of said drive shaft.

3. The device as claimed in claim 2, wherein said teeth of the belt are positioned outside of an image forming range of said belt.

4. The device as claimed in claim 1, wherein said drive shaft is provided with a member having a large coefficient of friction on a surface thereof for driving the belt.

5. The device as claimed in claim 1, wherein the belt comprises at least one of an intermediate image transfer belt and a sheet conveyance belt included in an image forming apparatus.

6. The device as claimed in claim 1, wherein the belt is passed over said drive shaft and a plurality of rollers, and at least one of said plurality of rollers positioned at a nip for image transfer has an axial length so selected as not to contact said teeth of the belt.

7. A device for moving a belt with an output torque of a motor, said device comprising:

a drive shaft configured to cause the belt to move;

transmitting means for transmitting the output torque of the motor to said drive shaft;

marker sensing means for sensing a marker, which is provided on the belt, to thereby determine a position of said belt in a direction of movement of said belt;

rotation condition sensing means for sensing a rotation condition of said drive shaft;

first correction information generating means for generating, based on an output of said rotation condition sensing means, correction information for correcting a rotation condition of said drive shaft; and control means for controlling a movement of the motor in accordance with said correction information output from said first correction information generating means and said second correction information generating means, wherein when a cross frequency Wcd of an open-loop transfer characteristic from a target drive shaft angle to a drive shaft angle including a controller with respect to said drive shaft and a natural oscillation frequency Wpd from a drive shaft torque to a surface position of the belt are related as Wcd>Wpd, said control means controls said target drive shaft angle in such a manner as to cancel a deviation of the surface position of said belt from a target surface position.

8. A device for moving a belt with an output torque of a motor, said device comprising;

a drive shaft configured to cause the belt to move;

transmitting means for transmitting the output torque of the motor to said drive shaft;

marker sensing means for sensing a marker, which is provided on the belt, to thereby determine a position of said belt in a direction of movement of said belt;

rotation condition sensing means for sensing a rotation condition of said drive shaft;

first correction information generating means for generating, based on an output of said marker sensing means, correction information for correcting the position of the belt in the direction of movement;

second correction information generating means for generating, based on an output of said rotation condition sensing means, correction information for correcting a rotation condition of said drive shaft; and control means for controlling a movement of the motor in accordance with said correction information output from said first correction information generating means and said second correction information generating means, wherein said control means controls an outside feedback loop such that a cross frquency Wcd of an inside feedback loop, which feeds back the rotation condition of said drive shaft sensed by said rotation condition sensing means to thereby cause said drive shaft to follow a target drive shaft position, and a cross frequency Wcs of an open-loop transfer characteristic from a target position of the belt inclusive of a controller of an inside feedback loop are related as Wcd>Wcs.

9. A device for moving a belt with an output torque of a motor, said device comprising:

a drive shaft configured to cause the belt to move;

transmitting means for transmitting the output torque of the motor to said drive shaft;

marker sensing means for sensing a marker, which is provided on the belt, to thereby determine a position of said belt in a direction of movement of said belt;

rotation condition sensing means for sensing a rotation condition of said drive shaft;

first correction information generating means for generating, based on an output of said marker sensing means, correction information for correcting the position of the belt in the direction of the movement;

second correction information generating means for generating, based on an output of said rotation condition sensing means, correction information for correcting a rotation condition of said drive shaft; and control means for controlling a movement of the motor in accordance with said correction information output from said first correction information generating means and said second correction information generating means, wherein said control means comprises a disturbance estimation observer added to a PI controller and provides a slope of a cross frequency Wcs of an open-loop transfer function from a target position to a surface position of the belt with an integration characteristic of −20 db/dec.

10. A device for moving a belt with an output torque of a motor, said device comprising:

a drive shaft configured to cause the belt to move;

transmitting means for transmitting the output torque of the motor to said drive shaft;

marker sensing means for sensing a marker, which is provided on the belt, to thereby determine a position of said belt in a direction of movement of said belt;

rotation condition sensing means for sensing a rotation condition of said drive shaft;

first correction information generating means for generating, based on an output of said marker sensing means, correction information for correcting the position of the belt in the direction of the movement;

second correction information generating means for generating, based on an output of said rotation condition sensing means, correction information for correcting a rotation condition of said drive shaft; and control means for controlling a movement of the motor in accordance with said correction information output from said first correction information generating means and said second correction information generating means;

wherein said control means comprises a feed-forward circuit configured to multiply, at the beginning of drive of the belt, a target position of a ramp function by a function selected to make said target position smooth, generate a signal representative of a resulting new target position to be compared with a measured output, and multiply said function selected to make said target position smooth by a reciprocal of a transfer function of a subject of control for thereby feeding a feed-forward current of the motor.

11. The device as claimed in claim 1, wherein transmitting means between the motor and said drive shaft comprises a timing belt and a timing pulley.

12. The device as claimed in claim 1, wherein transmitting means between the motor and said drive shaft comprises a gear train.

13. The device as claimed in claim 1, wherein transmitting means between an output shaft of the motor and said drive shaft comprises direct drive in which said output shaft and said drive shaft are constructed integrally with each other or connected to each other by a coupling.

14. The device as claimed in claim 1, wherein said control means comprises signal interpolating means for digitizing a maker representative of a slit pattern sensed by said marker sensing means, and interpolates, based on a resulting digital output, intervals between slits of said slit pattern.

15. The device as claimed in claim 1, wherein said control means comprises signal interpolating means for interpolating a clock with a frequency shorter than said signal pulses in intervals between edges of signal pulses, which are representative of a marker derived from a slit pattern sensed by said marker sensing means, with respect to time.

16. The device as claimed in claim 1, wherein said control means comprises a single DSP (Digital Signal Processor) or a single microcomputer for controlling drive of the belt.

17. A device for moving a belt with an output torque of a motor, said device comprising:

a drive shaft configured to cause the belt to move;

transmitting means for transmitting the output torque of the motor to said drive shaft;

marker sensing means for sensing a marker, which is provided on the belt, to thereby determine a position of said belt in a direction of movement of said belt;

rotation condition sensing means for sensing a rotation condition of said drive shaft;

first correction information generating means for generating, based on an output of said marker sensing means, correction information for correcting the position of the belt in the direction of movement;

second correction information generating means for generating, based on an output of said rotation condition sensing means, correction information for correcting a rotation condition of said drive shaft; and control means for controlling a movement of the motor in accordance with said correction information output from said first correction information generating means and said second correction information generating means;

wherein said control means comprises a single DSP (Digital Signal Processor) or a single microcomputer for controlling drive of the belt, and wherein to calculate servo drive with the DSP or the microcomputer, said control means delivers to the motor a result of calculation made discrete by a sampling time of control operation.

18. The device as claimed in claim 1, wherein said rotation condition sensing means comprises an eccentricity correction encoder coaxial with said drive shaft or the output shaft of the motor.

19. A device for rotating a drive shaft with an output torque of a motor to thereby drive at least one of an intermediate image transfer belt and a sheet conveyance belt included in an image forming apparatus, said device comprising:

sensing means for sensing a surface position of the belt; and position control means for feeding back a surface position sensed by said sensing means to thereby cause a surface position of the subject of drive to follow a target position, wherein said control means comprises signal interpolating means for interpolating a clock with a frequency shorter than said signal pulses in intervals between edges of signal pulses, which are representative of a marker derived from a slit pattern sensed by said marker sensing means, with respect to time.

20. The device as claimed in claim 19, wherein teeth are formed on at least a single portion of said drive shaft in an axial direction of said drive shaft, and teeth are formed on the belt and held in mesh with said teeth of said drive shaft.

21. The device as claimed in claim 20, wherein said teeth of the belt are positioned outside of an image forming range of said belt.

22. The device as claimed in claim 19 wherein said drive shaft is provided with a member having a large coefficient of friction on a surface thereof for driving the belt.

23. The device as claimed in claim 19, wherein the belt is passed over said drive shaft and a plurality of rollers, and at least one of said plurality of rollers positioned at a nip for image transfer has an axial length so selected as not to contact said teeth of the belt.

24. A device for rotating a drive shaft with an output torque of a motor to thereby drive at least one of an intermediate image transfer belt and a sheet conveyance belt included in an image forming apparatus, said device comprising:

sensing means for sensing a surface position of the belt; and position control means for feeding back a surface position sensed by said sensing means to thereby cause a surface position of the subject of drive to follow a target position, wherein when a cross frequency Wcs of an open-loop transfer characteristic from a target position to a surface position of the belt inclusive of a controller and a natural oscillation frequency Wpdm from a torque of said drive shaft or the output torque of the motor to said surface position are related as Wpdm>Wcs, and when stable control can be executed, said control means feeds back only said surface position of said belt to thereby obviate a deviation of a surface position of said belt from a target surface position.

25. A device for rotating a drive shaft with an output torque of a motor to thereby drive at least one of an intermediate image transfer belt and a sheet conveyance belt included in an image forming apparatus, said device comprising:

sensing means for sensing a surface position of the belt; and position control means for feeding back a surface position sensed by said sensing means to thereby cause a surface position of the subject to drive to follow a target position, wherein said control means comprises a disturbance estimation observer added to a PI controller and provides a slope of a cross frequency Wcs of an open-loop transfer function from a target position to a surface position of the belt with an integration characteristic of −20 db/dec.

26. A device for rotating a drive shaft with an output torque of a motor to thereby drive at least one of an intermediate image transfer belt and a sheet conveyance belt included in an image forming apparatus, said device comprising:

sensing means for sensing a surface position of the belt; and position control means for feeding back a surface position sensed by said sensing means to thereby cause a surface position of the subject of drive to follow a target position, wherein said control means comprises a feed-forward circuit configured to multiply, at the beginning of drive of the belt, a target position of a ramp function by a function selected to make said target position smooth, generate a signal representative of a resulting new target position to be compared with a measured output, and multiply said function selected to make said target position smooth by a reciprocal of a tranfer function of a subject of control for thereby feeding a feed-forward current to the motor.

27. The device as claimed in claim 19, wherein transmitting means between the motor and said drive shaft comprises a timing belt and a timing pulley.

28. The device as claimed in claim 19, wherein transmitting means between the motor and said drive shaft comprises a gear train.

29. The device as claimed in claim 19, wherein transmitting means between an output shaft of the motor and said drive shaft comprises direct drive in which said output shaft and said drive shaft are constructed integrally with each other or connected to each other by a coupling.

30. The device as claimed in claim 19, wherein said control means comprises signal interpolating means for digitizing a maker representative of a slit pattern sensed by said marker sensing means, and interpolating, based on a resulting digital output, intervals between slits of said slit pattern.

31. The device as claimed in claim 19, wherein said control means comprises a single DSP or a single microcomputer for controlling drive of the belt.

32. The device as claimed in claim 19, wherein to calculate serve drive with the DSP or the microcomputer, said control means delivers to the motor a result of calculation made discrete by a sampling time of control operation.

33. The device as claimed in claim 19, wherein said rotation condition sensing means comprises an eccentricity correction encoder coaxial with said drive shaft or the output shaft of the motor.

34. A device for rotating a drive shaft with an output torque of a motor to thereby drive at least one of an intermediate image transfer belt and a sheet conveyance belt included in an image forming apparatus, said device comprising:

rotation condition sensing means for sensing a rotation condition of an output shaft of the motor; and control means for feeding back a rotation condition sensed by said rotation condition sensing means to thereby cause a position of the output shaft to follow a target output shaft position such that a shift of a surface position of the belt from a target surface position is canceled, wherein said control means comprises signal interpolating means for interpolating a clock with a frequency shorter than said signal pulses in intervals between edges of signal pulses, which are representative of a marker derived from a slit pattern sensed by said marker sensing means, with respect to time.

35. The device as claimed in claim 34, wherein teeth are formed on at least a single portion of said drive shaft in an axial direction of said drive shaft, and teeth are formed on the belt and held in mesh with said teeth of said drive shaft.

36. The device as claimed in claim 35, wherein said teeth of the belt are positioned outside of an image forming range of said belt.

37. The device as claimed in claim 34, wherein said drive shaft is provided with a member having a large coefficient of friction on a surface thereof for driving the belt.

38. The device as claimed in claim 34, wherein the belt is passed over said drive shaft and a plurality of rollers, and at least one of said plurality of rollers positioned at a nip for image transfer has an axial length so selected as not to contact said teeth of the belt.

39. A device for rotating a drive shaft with an output torque of a motor to thereby drive at least one of an intermediate image transfer belt and a sheet conveyance belt included in an image forming apparatus, said device comprising:

rotation condition sensing means for sensing a rotation condition of an output shaft of the motor; and control means for feeding back a rotation condition sensed by said rotation condition sensing means to thereby cause a position of the output shaft to follow a target output shaft position such that a shift of a surface position of the belt from a target surface position is canceled, wherein when a cross frequency Wcm of an open-loop transfer characteristic from a target motor shaft angle to a motor shaft angle inclusive of a mechanical line up to a controller and said drive shaft with respect to said drive shaft and a natural oscillation frequency Wpd from a torque of said drive shaft to a surface position of that belt related as Wcm>Wpd, said control means controls said target motor shaft angle in such a manner as to cancel a deviation of said belt from a target surface position.

40. A device for rotating a drive shaft with an output torque of a motor to thereby drive at least one of an intermediate image transfer belt and a sheet conveyance belt included in an image forming apparatus, said device comprising:

rotation condition sensing means for sensing a rotation condition of an output shaft of the motor; and control means for feeding back a rotation condition sensed by said rotation condition sensing means to thereby cause a position of the output shaft to follow a target output shaft position such that a shift of a surface position of the belt from a target surface position is canceled, wherein said control means controls an outside feedback loop such that a cross frequency Wcm of an inside feedback loop, which feeds back the rotation condition of said drive shaft sensed by said rotation condition sensing means to thereby cause said drive shaft to follow a target drive shaft position, and a cross frequency Wcs of an open-loop transfer function from a target position to a surface position of the belt inclusive of a controller of said inside feedback loop are related as Wcm>Wcs.

41. A device for rotating a drive shaft with an output torque of a motor to thereby drive at least one of an intermediate image transfer belt and a sheet conveyance belt included in an image forming apparatus, said device comprising:

rotation condition sensing means for sensing a rotation condition of an output shaft of the motor; and control means for feeding back a rotation condition sensed by said rotation condition sensing means to thereby cause a position of the output shaft to follow a target output shaft position such that a shift of a surface position of the belt from a target surface position is canceled, wherein said control means comprises a disturbance estimation observer added to a PI controller and provides a slope of a cross frequency Wcs of an open-loop transfer function from a target position to a surface position of the belt with an integration characteristic of −20 db/dec.

42. A device for rotating a drive shaft with an output torque of a motor to thereby drive at least one of an intermediate image transfer belt and a sheet conveyance belt included in an image forming apparatus, said device comprising:

rotation condition sensing means for sensing a rotation condition of an output shaft of the motor; and control means for feeding back a rotation condition sensed by said rotation condition sensing means to thereby cause a position of the output shaft to follow a target output shaft position such that a shift of a surface position of the belt from a target surface position is canceled, wherein said control means comprises a feed-forward circuit configured to multiply, at the beginning of drive of the belt, a target position of a ramp function by a function selected to make said target position smooth, generate a signal representative of a resulting new target position to be compared with a measured output, and multiply said function selected to make said target position smooth by a reciprocal of a transfer function of a subject of control for thereby feeding a feed-forward current to the motor.

43. A device for rotating a drive shaft with an output torque of a motor to thereby drive at least one of an intermediate image transfer belt and a sheet conveyance belt included in an image forming apparatus, said device comprising:

rotation condition sensing means for sensing a rotation condition of an output shaft of the motor; and control means for feeding back a rotation condition sensed by said rotation condition sensing means to thereby cause a position of the output shaft to follow a target output shaft position such that a shift of a surface position of the belt from a target surface position is canceled, wherein transmitting means between the motor and said drive shaft comprises a timing belt and a timing pulley.

44. The device as claimed in claim 34, wherein transmitting means between the motor and said drive shaft comprises a gear train.

45. The device as claimed in claim 34, wherein transmitting means between an output shaft of the motor and said drive shaft comprises direct drive in which said output shaft and said drive shaft are constructed integrally with each other or connected to each other by a coupling.

46. The device as claimed in claim 34, wherein said control means comprises signal interpolating means for digitizing a maker representative of a slit pattern sensed by said marker sensing means, and interpolating, based on a resulting digital output, intervals between slits of said slit pattern.

47. The device as claimed in claim 34, wherein said control means comprises a single DSP or a single microcomputer for controlling drive of the belt.

48. The device as claimed in claim 47, wherein to calculate serve drive with the DSP or the microcomputer, said control means delivers to the motor a result of calculation made discrete by a sampling time of control operation.

49. The device as claimed in claim 34, wherein said rotation condition sensing means comprises an eccentricity correction encoder coaxial with said drive shaft or the output shaft of the motor.

50. An image forming apparatus comprising:

an intermediate image transfer belt;

a belt moving device for moving said intermediate image transfer belt with an output torque of a motor; and image forming means for forming an image in a plurality of colors on a sheet by controlling movement of said intermediate image transfer belt;

said belt moving device comprising:

a drive shaft configured to cause said intermediate image transfer belt to move;

transmitting means for transmitting the output torque of the motor to said drive shaft;

marker sensing means for sensing a marker, which is provided on said intermediate image transfer belt, to thereby determine a position of said intermediate image transfer belt in a direction of movement of said intermediate image transfer belt;

rotation condition sensing means for sensing a rotation condition of said drive shaft;

first correction information generating means for generating, based on an output of said marker sensing means, correction information for correcting the position of said intermediate image transfer belt in the direction of movement;

second correction information generating means for generating, based on an output of said rotation condition sensing means, correction information for correcting a rotation condition of said drive shaft; and control means for controlling a movement of the motor in accordance with said correction information output from said first correction information generating means and said second correction information generating means, wherein said correction information generated by said first correction information generating means has a lower maximum response frequency than said correction information generated by said second correction information generating means.

51. An image forming apparatus comprising:

an intermediate image transfer belt;

a belt moving device for driving at least one of an intermediate image transfer belt and a sheet conveyance belt with an output torque of a motor; and image forming means for forming an image in a plurality of colors on a sheet by controlling movement of said intermediate image transfer belt;

image forming means for forming an image in a plurality of colors on a sheet by controlling movement of said intermediate image transfer belt;

said belt moving device comprising:

sensing means for sensing a surface position of a subject of drive; and position control means for feeding back a surface position sensed by said sensing means to thereby cause a surface position of a subject of drive to follow a target position, wherein said control means comprises signal interpolating means for interpolating a clock with a frequency shorter thatn said signal pulses in intervals between edges of signal pulses, which are representative of a marker derived from a slit pattern sensed by said marker sensing means, with respect to time.

52. An image forming apparatus comprising:

an intermediate image transfer belt; and a belt moving device for driving either one of an intermediate image transfer belt and a sheet conveyance belt with an output torque of a motor; and image forming means for forming an image in a plurality of colors on a sheet by controlling movement of said intermediate image transfer belt;

said belt moving device comprising:

rotation condition sensing means for sensing a rotation condition of an output shaft of the motor; and control means for feeding back a rotation condition sensed by said rotation condition sensing means to thereby cause a position of an output shaft of the motor to follow a target output shaft position such that a deviation of a surface position of said intermediate image transfer belt from a target surface position is canceled, wherein said control means comprises signal interpolating means for interpolating a clock with a frequency shorter than said signal pulses in intervals between edges of signal pulses, which are representative of a marker derived from a slit pattern sensed by said marker sensing means, with respect to time.

* * * * *